US007921939B1

(12) United States Patent
Keast et al.

(10) Patent No.: US 7,921,939 B1
(45) Date of Patent: Apr. 12, 2011

(54) METHOD FOR USING A TOP DRIVE WITH AN AIR LIFT THREAD COMPENSATOR AND A HOLLOW CYLINDER ROD PROVIDING MINIMUM FLEXING OF CONDUIT

(75) Inventors: Larry G. Keast, Houston, TX (US); James Strickland, Houston, TX (US); Alan Shem, Houston, TX (US)

(73) Assignee: Larry G. Keast, Houston, TX (US)

( * ) Notice: Subject to any disclaimer, the term of this patent is extended or adjusted under 35 U.S.C. 154(b) by 0 days.

(21) Appl. No.: 12/861,534

(22) Filed: Aug. 23, 2010

(51) Int. Cl.
*E21B 3/02* (2006.01)
*E21B 19/02* (2006.01)

(52) U.S. Cl. ..... 175/113; 175/162; 175/203; 175/220; 166/75.11; 166/379

(58) Field of Classification Search ..... 175/162, 175/113, 203, 220; 166/379, 75.11
See application file for complete search history.

(56) References Cited

U.S. PATENT DOCUMENTS

2009/0274545 A1* 11/2009 Liess et al. ..... 414/800
2010/0101805 A1* 4/2010 Angelle et al. ..... 166/380

* cited by examiner

*Primary Examiner* — William P Neuder
*Assistant Examiner* — Brad Harcourt
(74) *Attorney, Agent, or Firm* — Buskop Law Group, PC; Wendy Buskop

(57) ABSTRACT

A method for using a top drive is disclosed herein. The method can include: actuating a motor to provide power to the top drive, thereby rotating a stem with a saver sub mounted to a top drive housing having a bearing disposed about the rotatable stem; grabbing, lifting, and positioning tubulars using an elevator; and suspending weight of the top drive to prevent damage to threads of the tubulars during threadable engagement and disengagement of the tubulars using an air-bag of an airlift thread compensator. The method can further include: positioning a torque wrench assembly along the tubulars for connecting the tubulars using a hydraulic cylinder disposed inside a torque supporting telescoping tubes; and movably positioning a single hollow cylinder rod of the hydraulic cylinder to extend into a first and second protected area, thereby preventing axial movement of a flexible hose during operation of the torque wrench assembly.

20 Claims, 20 Drawing Sheets

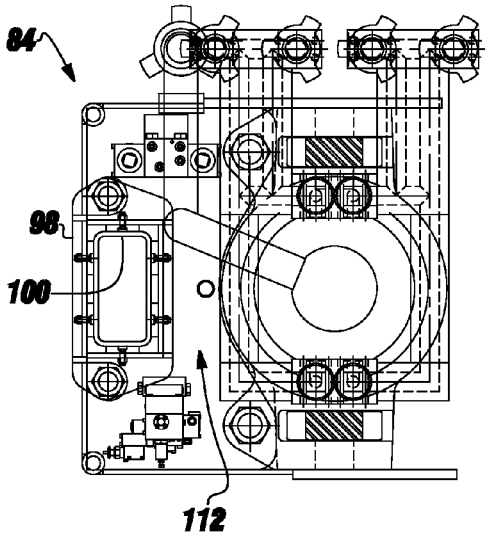
FIGURE 5B
FIGURE 5C
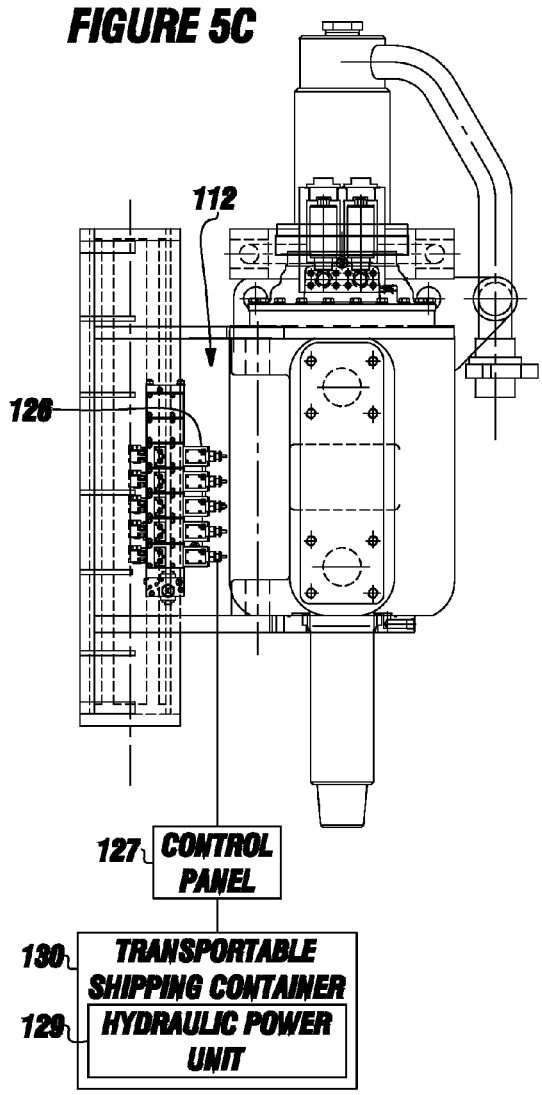

FIGURE 9D

9C

LOWERING THE SECOND TUBULAR THROUGH THE RIG FLOOR SUBSTRUCTURE UNTIL THREADS OF THE SECOND TUBULAR ENGAGE THE THREADS OF THE FIRST TUBULAR — 994

LOWERING THE TOP DRIVE UNTIL THE THREADS OF THE SAVER SUB ENGAGE THREADS OF THE SECOND TUBULAR — 996

USING THE AIRBAG TO SUSPEND WEIGHT OF THE TOP DRIVE TO PREVENT DAMAGE TO THE THREADS DURING THREADABLE ENGAGEMENT OF THE SECOND TUBULAR TO THE SAVER SUB AND TO THE FIRST TUBULAR — 998

THREADABLY CONNECTING THE SECOND TUBULAR TO SAVER SUB AND TO THE FIRST TUBULAR USING THE TOP DRIVE WHILE SIMULTANEOUSLY SUSPENDING THE WEIGHT OF THE TOP DRIVE USING THE AIRBAG — 1000

RELEASING THE SUSPENSION OF THE FIRST TUBULAR WITH THE DRILL BIT FROM SLIPS — 1002

ROTATING THE CONNECTED TUBULARS TO DRILL IN THE GROUND BENEATH THE RIG FLOOR USING THE MOTOR — 1004

REPEATING THE STEPS DESCRIBED IN BOXES 978-1004 AS MORE TUBULARS ARE REQUIRED FOR DRILLING INTO THE GROUND — 1006

PULLING OUT OF THE WELL BORE — 1008

STOPPING ROTATION OF THE CONNECTED TUBULARS TO CEASE DRILLING IN THE GROUND BENEATH THE RIG FLOOR — 1010

RAISING THE CONNECTED TUBULARS UNTIL A CONNECTION OF THE TUBULARS IS POSITIONABLE TO HANG FROM THE SLIPS — 1012

HANGING THE CONNECTED TUBULARS FROM THE SLIPS — 1014

USING THE AIRBAG TO SUSPEND THE WEIGHT OF THE TOP DRIVE TO PREVENT DAMAGE TO THREADS OF THE CONNECTED TUBULARS — 1016

THREADABLY DISCONNECTING A PORTION OF THE CONNECTED TUBULARS, FORMING A STAND OF TUBULARS, WHILE SIMULTANEOUSLY SUSPENDING THE WEIGHT OF THE TOP DRIVE USING THE AIRBAG — 1018

BREAKING OUT AND UNSCREWING THE STAND OF TUBULARS FROM THE SAVER SUB USING THE TORQUE WRENCH HEAD — 1020

MANUALLY BREAKING OUT THE STAND OF TUBULARS FROM THE REMAINING CONNECTED TUBULARS SUSPENDED FROM THE SLIPS — 1022

9E

FIGURE 9E

9D

USING THE ELEVATOR TO MOVE THE STAND OF TUBULARS TO A RACKING POSITION ON THE RIG FLOOR — 1024

REPEATING THE STEPS DESCRIBED IN BOXES 1010-1024 UNTIL ALL CONNECTED TUBULARS ARE OUT OF THE WELL BORE — 1026

TRIPPING BACK INTO THE WELL BORE — 1028

USING THE ELEVATOR TO LIFT A FIRST STAND OF TUBULARS FROM THE RACKING POSITION — 1030

USING THE ELEVATOR TO LOWER THE FIRST STAND OF TUBULARS INTO THE WELL BORE AND TO HANG THE FIRST STAND OF TUBULARS FROM THE SLIPS — 1032

USING THE ELEVATOR TO LIFT A SECOND STAND OF TUBULARS FROM THE RACKING POSITION — 1034

USING THE ELEVATOR TO LOWER THE SECOND STAND OF TUBULARS INTO ENGAGEMENT WITH THE FIRST STAND OF TUBULARS — 1036

USING THE AIRBAG TO SUSPEND THE WEIGHT OF THE TOP DRIVE — 1038

THREADABLY CONNECTING THE SECOND STAND OF TUBULARS TO THE FIRST STAND OF TUBULARS AND TO THE SAVER SUB BY: MANUALLY SCREWING THE SECOND STAND OF TUBULARS TO THE FIRST STAND OF TUBULARS; AND SCREWING THE SECOND STAND OF TUBULARS TO THE SAVER SUB USING THE TORQUE WRENCH HEAD WHILE SIMULTANEOUSLY SUSPENDING THE WEIGHT OF THE TOP DRIVE USING THE AIRBAG — 1040

REPEATING THE STEPS DESCRIBED IN BOXES 1030-1040 UNTIL ALL STANDS OF TUBULARS ARE CONNECTED AND DISPOSED WITHIN THE WELL BORE — 1042

ACTUATING THE MOTOR TO PROVIDE POWER TO THE TOP DRIVE, THEREBY ROTATING THE ROTATABLE STEM AND THE CONNECTED STANDS OF TUBULARS WITH THE SAVER SUB TO DRILL IN THE WELL BORE — 1044

SUSPENDING A TORQUE TRACK FROM A CROWN OF THE DERRICK AND CONNECTING THE TORQUE TRACK TO THE RIG FLOOR OR TO THE RIG FLOOR SUBSTRUCTURE — 1046

SLIDABLY ATTACHING A TORQUE SLIDE ASSEMBLY TO THE TORQUE TRACK — 1048

ENGAGING A TOP PLATE OF THE TORQUE SLIDE ASSEMBLY WITH THE TOP DRIVE HOUSING — 1050

ENGAGING A BOTTOM PLATE OF THE TORQUE SLIDE ASSEMBLY WITH THE TOP DRIVE HOUSING — 1052

ENGAGING A ROTATABLE SLIDE DOOR AROUND A RECTANGULAR TORQUE REACTION TUBE OF THE TORQUE SLIDE ASSEMBLY — 1054

9F

FIGURE 9F

9E

POSITIONING THE TORQUE WRENCH ASSEMBLY ALONG AT LEAST ONE TUBULAR FOR THREADABLY CONNECTING OR DISCONNECTING THE TUBULAR TO THE SAVER SUB USING A HYDRAULIC CYLINDER — 1056

CONNECTING A FIRST END OF THE SINGLE HOLLOW CYLINDER ROD TO A TOP FLEXIBLE CONDUIT IN FLUID COMMUNICATION WITH A HYDRAULIC FLUID SOURCE FOR RECEIVING HYDRAULIC FLUID — 1058

MOVABLY POSITIONING THE FIRST END OF THE SINGLE HOLLOW CYLINDER ROD TO EXTEND OUT OF THE FIRST END OF THE HYDRAULIC CYLINDER INTO A FIRST PROTECTED AREA BETWEEN THE TORQUE SLIDE ASSEMBLY AND THE TOP DRIVE HOUSING — 1060

CONNECTING A SECOND END OF THE SINGLE HOLLOW CYLINDER ROD TO A BOTTOM FLEXIBLE CONDUIT IN FLUID COMMUNICATION WITH THE TORQUE WRENCH HEAD FOR PROVIDING HYDRAULIC FLUID TO THE TORQUE WRENCH HEAD FROM THE HYDRAULIC FLUID SOURCE — 1062

MOVABLY POSITIONING THE SECOND END OF THE SINGLE HOLLOW CYLINDER ROD CONNECTED TO THE BOTTOM FLEXIBLE CONDUIT SUCH THAT THE SECOND END OF THE SINGLE HOLLOW CYLINDER ROD EXTENDS OUT OF THE SECOND END OF THE HYDRAULIC CYLINDER AND INTO A SECOND PROTECTED AREA WITHIN THE PAIR OF TORQUE SUPPORTING TELESCOPING RECTANGULAR TUBES, THE TORQUE WRENCH ASSEMBLY, OR COMBINATIONS THEREOF, WHEREIN PROVIDING HYDRAULIC FLUID TO THE TORQUE WRENCH HEAD THROUGH THE TOP FLEXIBLE CONDUIT AND THE SINGLE HOLLOW CYLINDER ROD PREVENTS FLEXING AND AXIAL MOVEMENT OF THE BOTTOM FLEXIBLE CONDUIT — 1064

GRIPPING AT LEAST ONE TUBULAR USING THE TORQUE WRENCH HEAD BEFORE THREADABLY CONNECTING OR DISCONNECTING THE TUBULAR TO ANOTHER TUBULAR OR TO THE SAVER SUB — 1066

SUPPORTING WEIGHT OF THE AT LEAST ONE TUBULAR WITH ONLY TELESCOPING MOVEMENT USING THE PAIR OF TORQUE SUPPORTING TELESCOPING RECTANGULAR TUBES WHILE THREADABLY CONNECTING OR DISCONNECTING THE TUBULAR TO ANOTHER TUBULAR OR TO THE SAVER SUB, WHILE SIMULTANEOUSLY SUSPENDING THE WEIGHT OF THE TOP DRIVE USING THE AIRBAG — 1068

LOCKING THE CONNECTION OF THE INSIDE BLOW OUT PREVENTER TO THE ROTATABLE STEM USING AN UPPER CLAMP ASSEMBLY — 1070

LOCKING THE CONNECTION OF THE INSIDE BLOW OUT PREVENTER TO THE SAVER SUB USING A LOWER CLAMP ASSEMBLY — 1072

9G

METHOD FOR USING A TOP DRIVE WITH AN AIR LIFT THREAD COMPENSATOR AND A HOLLOW CYLINDER ROD PROVIDING MINIMUM FLEXING OF CONDUIT

FIELD

The present embodiments generally relate to a method for using a top drive having an airlift thread compensator and a hollow cylinder rod providing minimum flexing of hosing.

BACKGROUND

A need exists for method for using a top drive having an airlift thread compensator that has an airbag for supporting weight of the top drive during threadable engagement and disengagement of tubulars using the top drive, thereby reducing or eliminating the need for high pressure gas and reducing the number of points of failure of the system.

A need exists for method for using a top drive having a vertically positionable torque wrench assembly that has a hydraulic cylinder with a single hollow cylinder rod disposed therethrough and extending into protected areas, thereby reducing or eliminating the occurrence of axial movement of a flexible hydraulic hose of the torque wrench assembly, and protecting the flexible hose from exterior forces.

A need exists for method for using a torque wrench assembly that has a spring open feature, thereby reducing the need for an extra hydraulic hose for use in opening the torque wrench assembly.

The present embodiments meet these needs.

BRIEF DESCRIPTION OF THE DRAWINGS

The detailed description will be better understood in conjunction with the accompanying drawings as follows:

FIGS. 5A-5C depict an embodiment of the top drive with a torque wrench assembly, a control panel, and a power unit.

FIGS. 9A-9G depict an embodiment of a method of using the top drive.

Figure 1:
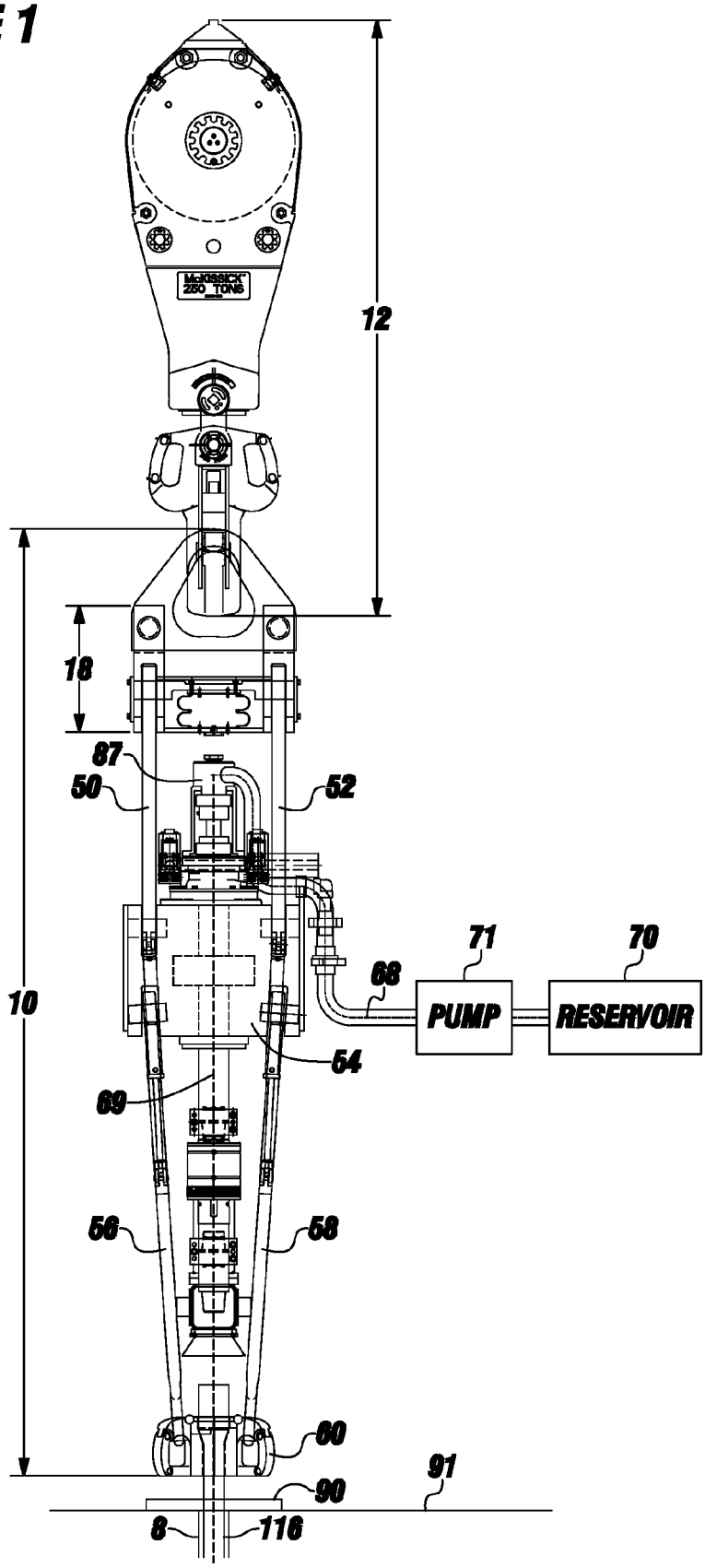
FIG. 1 depicts an embodiment of a top drive.

The present embodiments are detailed below with reference to the listed Figures.

DETAILED DESCRIPTION OF THE EMBODIMENTS

Before explaining the present method and associated apparatus in detail, it is to be understood that the method and associated apparatus are not limited to the particular embodiments and that the method and associated apparatus can be practiced or carried out in various ways.

The present embodiments relate to a method for using a top drive having an airlift thread compensator and a torque wrench assembly with a hollow cylinder rod providing minimum flexing of conduit. The top drive can be engaged with a travelling block with a hook, or a hook type traveling block on a drilling rig. For example, the airlift thread compensator can include a bail for engaging the travelling block with the hook.

The drilling rig, which can be used for drilling a well bore, can include a derrick having a crown. A top of a torque track can be suspended from the crown. A bottom of the torque track can be connected to a bottom of the drilling rig, such as to a rig floor or a rig floor substructure. The traveling block with the hook can be secured to a cable 158. The cable can extend from the hook, over at least one sheave mounted to a top of the derrick, and can be connected to a drawworks. A drawworks motor for turning the drawworks and raising or lowering the hook can be connected to the drawworks. The top drive can have a sliding engagement with the torque track, and can be removably affixed to the hook.

The airlift thread compensator can include an airlift enclosure. The airlift enclosure can be an airlift box that can be connected to the bail. The airlift enclosure can be made of steel. The airlift thread compensator can be an assembly of components that can be assembled into a one-piece unit.

The airlift enclosure can have a top, a bottom, at least two sides, and a door. For example the airlift enclosure can have an airlift enclosure bottom, a rear enclosure side connected to the airlift enclosure bottom, and a top enclosure side connected to the rear enclosure side opposite airlift enclosure bottom. A first enclosure side can be connected between the top enclosure side and the airlift enclosure bottom, and can be connected to a first edge of the rear enclosure side. A second enclosure side can be connected between the top enclosure side and the airlift enclosure bottom opposite the first enclosure side. The second enclosure side can also be connected to a second edge of the rear enclosure side opposite the first edge of the rear enclosure side.

In one or more embodiments, the first enclosure side of the airlift enclosure can be made of or can include a first double clevis that can be connected to the rear enclosure side. A second enclosure side of the airlift enclosure can be made of or can include a second double clevis that can be connected to the rear enclosure side opposite the first double clevis. In one or more embodiments the airlift enclosure can include a first side plate disposed between the first double clevis and the rear enclosure side, and a second side plate disposed between the second double clevis and the rear enclosure side. Each enclosure side can provide support to an airbag that can be disposed between both double devises.

Each double clevis can include a first link slot formed between a first bottom leg and a second bottom leg. Each double clevis can include a first bail slot formed between a first top leg and a second top leg of the first double clevis. The first bail slot can be formed perpendicular to the first link slot, as can be better understood with reference to the figures below.

The first double clevis can include a first pin slot, which can be oval, square, or any other shape that is configured to match a shape of a bail pin. The first pin slot can extend perpendicular to the first link slot of the first double clevis, and parallel to the first bail slot of the first double clevis. The first pin slot can be or can include holes formed through the first double clevis, such as through the first top leg and the second top leg, or through the first bottom leg and the second bottom leg. The first pin slot can pass through the first link slot. The second double clevis can include a second pin slot, which can be oval, square, or any other shape that is configured to match a shape of the bail pin. The second pin slot can be axially and/or concentrically aligned with the first pin slot. The second pin slot can extend perpendicular to the first link slot of the second double clevis, and parallel to the first bail slot of the second double clevis. The second pin slot can be or can include holes formed through the second double clevis, such as through the first top leg and the second top leg of the second double clevis, or through the first bottom leg and the second bottom leg of the second double clevis. The second pin slot can pass through the second link slot.

The bail can be engaged within the bail slot of both the first double clevis and the second double clevis, thereby connecting the bail to the airlift enclosure. In one or more embodiments, a first pin can be engaged through the first double clevis and into the bail, and a second pin can be engaged through the second double clevis and into the bail, thereby attaching each double clevis to the bail.

In one or more embodiments, the airlift enclosure can include a door. The door can be pivotably or rotatably connected to the first enclosure side of the airlift enclosure, the second enclosure side of the airlift enclosure, or combinations thereof. For example, the door can be attached to the first double clevis and the second double clevis with one or more hinges.

The door can provide access to the airbag that can disposed within the airlift enclosure. The airbag can be used to support and/or suspend weight of the entire top drive, such as during any screwing or unscrewing of tubulars or stands of tubular using the top drive. The airbag can be a useful alternative to the hydraulically operable systems that are currently used in the art to support and/or suspend the weight top drives. The airbag can operate more reliably than hydraulic cylinders connected to high pressure gas accumulators, such as nitrogen accumulators, which can require pressures of over five hundred psi and up to two thousand psi.

For example, many currently used systems require the use of complicated hydraulically operated systems that require numerous: hose connections, hydraulic parts, piston seals, rod seals, accumulator seals, fittings, connectors, valves, hydraulic cylinders, and high pressure gas accumulators. The high pressure gas accumulators can present a danger, and high pressure gas is not an otherwise normally available supply on drilling rigs; whereas the present system can utilize standard compress air sources at 120 psi to provide pressurization to the airbag. In one or more embodiments, air provided from the compressed air source can be at a pressure from about sixty to about seventy psi, depending upon weight of the top drive. Use of high pressure gas and high pressure gas accumulators can require trained operators due to the dangers involved. The unique use of the airbag described herein can thereby eliminate the need for costly, dangerous, and otherwise unnecessary equipment.

As mentioned above, hydraulically operated systems using high pressured gasses include and require numerous: hose connections, hydraulic parts, piston seals, rod seals, accumulator seals, fittings, connectors, valves, hydraulic cylinders, and high pressure gas accumulators, and other parts. Each of these parts of the hydraulically operated systems can be a point of failure, such as a leak. In the event of a failure of such as system, an operator would have to shut the entire system down and check every single potential point of failure for repairs before resuming operation of the system. The airbag described herein can include a single inflator valve. This single inflator valve can be the only connection point of the airbag that can be a potential point of failure. Therefore, upon occurrence of a failure of the system with the airbag, an operator would only need to check the inflator valve for repairs, and the airbag itself for damage, before resuming operation of the system. Therefore, the airbag reduces the amount of system shut down time and the number of points of failure of the system.

In one or more embodiments the airbag can be a pneumatic transport vehicle tire, a tire, an automotive tire or a similar device. An illustrative example of an airbag usable in embodiments is a Firestone air bag model 21-2. The airbag can include supportive cords, and can be constructed similarly to an automotive tire for resistance to degradation in harsh environments. The airbag can have a toroidal shape, a double toroidal, or another shape.

In operation, the inflator valve can be a valve stem configured to receive compressed air from a compressed air source for inflating the airbag, such as a Shrader™ valve. The inflator valve can be used to provide easy low pressure tank air, also called "rig air", from a compress air source, such as an air compressor. The inflator valve can be the same type of valve used in vehicle tires, therefore providing an equivalent level of safety and reliability.

The airbag can be removably connected to the airlift enclosure, such as to the airlift enclosure bottom; removably connected to a bail pin within the airlift enclosure; or combinations. In one or more embodiments the airbag can be connected to multiple bail pins. The airbag can be bolted to the airlift enclosure bottom. The bail pin can extend from the first enclosure side of the airlift enclosure, such as from and through the first double clevis, to the second enclosure side of the airlift enclosure, such as to and through the second double clevis. The bail pin can be disposed at least partially within the airlift enclosure beneath the top enclosure side. The bail pin can be engaged through the first pin slot, the first link slot, the second link slot, the second pin slot, or combinations thereof. The bail pin can be slidably and movably engaged within each slot. The bail pin can be round or any other shape, and can be made of steel or another material.

The airbag can be inflated by transmitting pressurized air into the airbag through the inflator valve. The airbag can be inflated until an assembled weight of the top drive is lifted and supported, causing the bail pin to rise in the first pin slot of the first double clevis and in the second pin slot of the second double clevis.

A first upper link can be slidably engaged within the first link slot. A second upper link can be slidably engaged within the second link slot. The second upper link can extend parallel to the first upper link. Each upper link can include a hole formed therein. In operation, each upper link can be slidably engaged within each respective link slot, and then the bail pin can be slidably engaged through the first pin slot, through the hole in the first upper link, through the first link slot, through the airlift enclosure beneath the top enclosure side, through the second link slot, through the hole in the second upper link, and through the second pin slot. The bail pin and each double clevis can thereby support weight of the upper links and anything connected to the upper links. As the bail pin can be attached to the airbag, the airbag can receive and support at least a portion of the weight of the upper links and anything connected to the upper links. In one or more embodiments, the airbag can be used to support and/or raise ten thousand pounds or more.

A top drive housing can be connected or pinned to the first upper link and to the second upper link. The top drive housing can be a steel housing configured to support a rotatable stem, also referred to as a main shaft, which can be mounted therein.

A motor, such as a hydraulic motor, can be splinably connected to the rotatable stem and mounted to the top drive housing. In one or more embodiments, the motor can at least partially extend into the top drive housing. In one or more embodiments at least one filter can be disposed in at least one port of the hydraulic motor. A heavy thrust bearing can be disposed around the rotatable stem within the top drive housing.

A first lower link can be connected or pinned to the top drive housing, and a second lower link can be connected or pinned to the top drive housing opposite the first lower link. The lower links can extend from the top drive housing and can be connected to an elevator, which can a manual or hydraulic elevator. The top drive can include at least one elevator hydraulic cylinder that can be used to kick out the elevator to grab a tubular or a stand of tubulars from a pipe rack, a V-door, a mouse hole, or another location.

An inside blow out preventer can be connected to the rotatable stem opposite from where the rotatable stem is mounted to the top drive housing, such as to a bottom end of the rotatable stem. An upper clamp assembly can lock the connection between the rotatable stem and the inside blow out preventer.

A saver sub can be connected to the inside blow out preventer opposite the inside blow out preventer. A lower clamp assembly, which can be the same type of clamp as the upper clamp assembly, can lock the connection between the inside blow out preventer and the saver sub.

In one or more embodiments, each clamp assembly can include one or more tong dies for preventing backing out or breaking off of any tool joint connections in the top drive, such as threaded connections between tubulars.

The top drive can include a torque wrench assembly that can be connected to the top drive housing, a torque slide assembly, or combinations thereof. The torque slide assembly can be configured to slide on the torque track. The torque track can be suspended from the crown of the derrick of the drilling rig. In one or more embodiments, the torque track can be hanging loose and only slightly tensioned, such that no torque loads are imparted onto the derrick.

The torque track can be connected to a rig floor sub structure opposite the crown. The torque slide assembly can include a body, also referred to as a slide body; a top plate engaged with the top drive housing; a bottom plate engaged with the top drive housing; and a torque assembly door. The torque assembly door can be a rotatable slide door that can be engaged around a rectangular torque reaction tube. The rotatable slide door can provide for easy installation and removal of the rectangular torque reaction tube.

The torque wrench assembly can include a pair of torque supporting telescoping rectangular tubes for supporting a torque load with only telescoping movement. The torque wrench assembly can include a hydraulic cylinder with a first end, a second end, and a single hollow cylinder rod disposed therethrough. The hydraulic cylinder can be disposed inside the torque supporting telescoping rectangular tubes. The single hollow cylinder rod can be moveably positionable within the hydraulic cylinder, such that the single hollow cylinder rod can movably extend out of the first end and the second end of the hydraulic cylinder.

The top drive can include a first protected area formed between the torque slide assembly and the top drive housing. For example, the first protected area can be formed between the top plate and the bottom plate of the torque slide assembly. The torque slide assembly, the top drive housing, the top plate, and the bottom plate can provide protection from external forces to the area therein.

The top drive can include a second protected area formed within the pair of torque supporting telescoping rectangular tubes, the torque wrench assembly, or combinations thereof.

A first end of the single hollow cylinder rod can extend into the first protected area between the torque slide assembly and the top drive housing. The first end of the single hollow cylinder rod can be hydraulically connected to a hydraulic fluid source, such as with a top flexible conduit. A second end of the single hollow cylinder rod can be connected to one of the pair of torque supporting telescoping rectangular tubes. The second end of the single hollow cylinder rod can extend into the second protected area. The second end of the single hollow cylinder rod can be hydraulically connected to a bottom flexible conduit. Each flexible conduit can be a hose. The bottom flexible conduit can be hydraulically connected to the torque wrench assembly, such as to a cylinder with a piston in a hydraulically operable torque wrench head of the torque wrench assembly.

The hydraulically operable torque wrench head can be adapted to grip a tubular or a stand of tubulars. For example, the tubular or stand of tubulars can be a drill pipe. In operation, the single hollow cylinder rod can provide fluid communication between the hydraulic fluid source and the hydraulically operable torque wrench head, which can actuate the hydraulically operable torque wrench head to grip a tubular or stand of tubulars disposed within the hydraulically operable torque wrench head. The torque wrench assembly can include a spring or multiple springs that can actuate to disengage the hydraulically operable torque wrench head. The use of a spring or multiple springs for disengagement of the torque wrench head reduces the need for another conduit to provide hydraulic fluid to the torque wrench head.

With the single hollow cylinder rod disposed within the hydraulic cylinder, extending into the first protected area and connected to the top flexible conduit, connected to the lower torque supporting telescoping rectangular tube, and extending into the second protected area and connected to the second flexible conduit, axial movement of the bottom flexible conduit can be prevented or at least minimized. For example, current systems include a single flexible conduit which requires substantial flexing and axial movement along the entire length of the flexible conduit from the hydraulic fluid source to the hydraulically operable torque wrench head where the single flexible conduit is exposed and in harms way proximate the torque wrench head. In the top drive disclosed herein, the hydraulic fluid can flow from the hydraulic fluid source, through top flexible conduit, through the rigid single hollow cylinder rod, through the bottom flexible conduit, and to the hydraulically operable torque wrench head. The top flexible conduit, which is protected within the first protected area, can be configured to flex and axially move within the first protected area. The single hollow cylinder rod can axially move within the hydraulic cylinder, providing a non-flexible flow path for the hydraulic fluid, thereby reducing the required amount of conduit within the system that is required to flex and move, and all flexing and movements still required by the system to occur within the protected areas. The top drive disclosed herein therefore requires less axial movement of the flexible conduits proximate the hydraulically operable torque wrench than current systems.

In one or more embodiments, the top drive housing can be connected to a wash pipe packing seal assembly for receiving a pressurized mud from a mud reservoir, a pump, or combinations thereof. The wash pipe packing seal assembly can be disposed over the hydraulic motor. The pressurized mud can flow to the wash pipe packing seal assembly at a pressure up to 5000 psi. The wash pipe packing seal assembly can flow the pressurized mud to a central mud flow path within rotatable stem of the top drive and to a drill bit connected to a tubular.

One or more solenoid valves can be mounted within the first protected area, and can be connected to a control panel for operating the top drive. A hydraulic power unit can be used to power the top drive. The hydraulic power unit can be built into a transportable shipping container.

Turning now to the figures, FIG. 1 depicts an embodiment of a top drive 10 engaged with a travelling block with a hook 12. The top drive 10 can include an airlift thread compensator 18, a first upper link 50, a second upper link 52, a top drive housing 54 connected to both upper links (50, 52), a first lower link 56 and a second lower link 58 connected to the top drive housing 54, and an elevator 60 connected to both lower links (56, 58).

The top drive 10 can be used for engaging a tubular or a stand of tubulars, such as tubular 116, which can be a drill pipe extending from a rig floor 90, through a rig floor sub structure 91, and into a well bore 8.

The top drive 10 can include a pump 71 in fluid communication with a reservoir 70 for flowing a pressurized mud 68 to a wash pipe packing seal assembly 87 connected to the top drive housing 54. The pressurized mud 68 can flow along a central mud flow path 69, such as to a drill bit that can be connected to the tubular 116.

Figure 2:
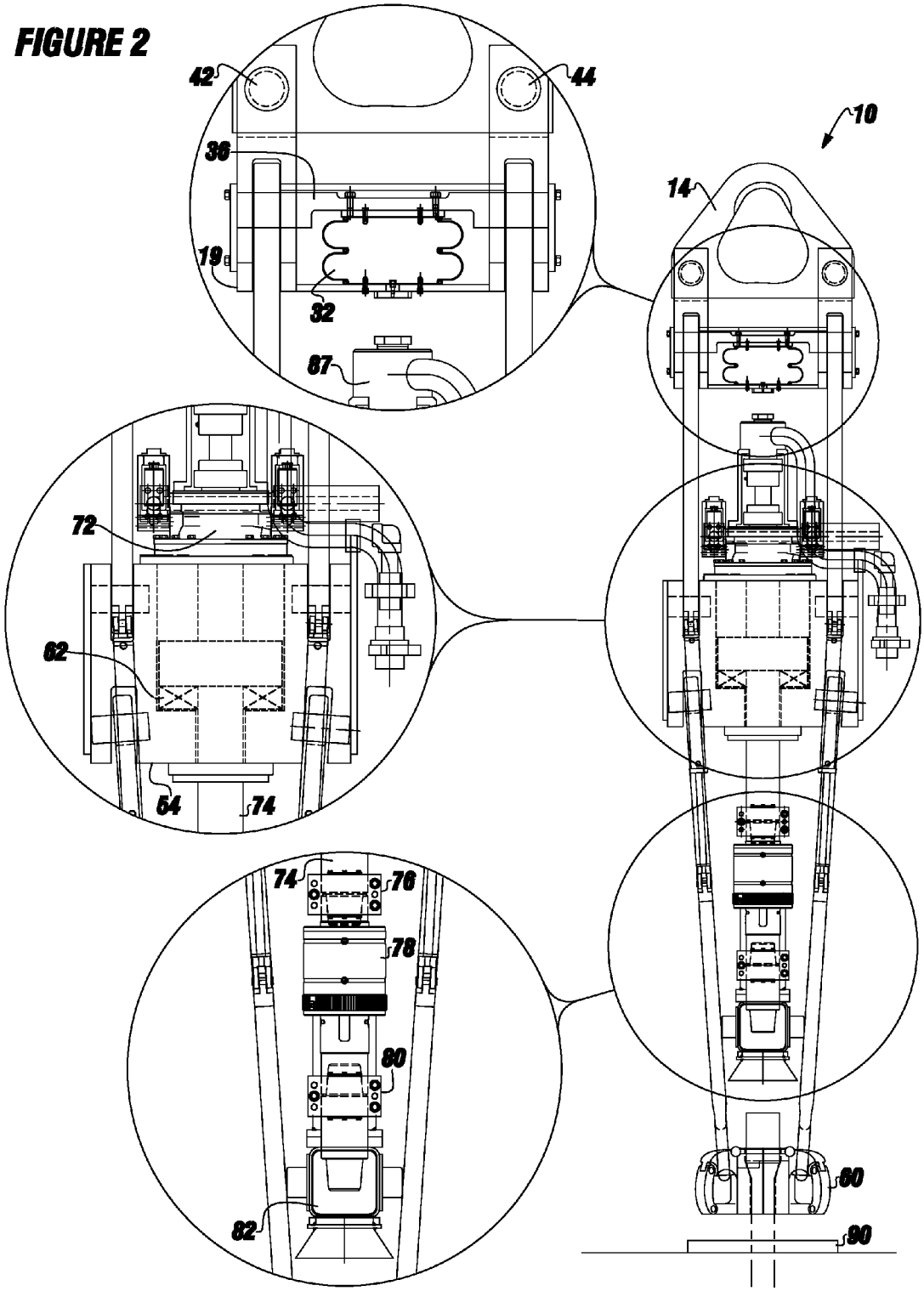
FIG. 2 depicts a detailed view of portions of the top drive.

FIG. 2 depicts details of portions of the top drive 10.

The airlift thread compensator can include or be connected to a bail 14. The bail 14 can be engaged with the travelling block with the hook.

The airlift thread compensator can include an airlift enclosure 19 connected to the bail 14, such as with a first pin 42 and a second pin 44. A bail pin 36 can extend through the airlift enclosure 19. An airbag 32 can be disposed within the airlift enclosure 19.

The top drive housing 54 can support a rotatable stem 74, which can be mounted therein. A motor 72 can be splinably connected to the rotatable stem 74 and mounted to the top drive housing 54. A heavy thrust bearing 62 can be disposed about the rotatable stem 74 within the top drive housing 54.

An inside blow out preventer 78 can be connected to the rotatable stem 74 and to a saver sub 82. An upper clamp assembly 76 can be disposed about and can lock the connection between the rotatable stem 74 and the inside blow out preventer 78. A lower clamp assembly 80 can be disposed about and can lock the connection between the inside blow out preventer 78 and the saver sub 82. Also shown are the elevator 60 and the rig floor 90.

Figure 3:
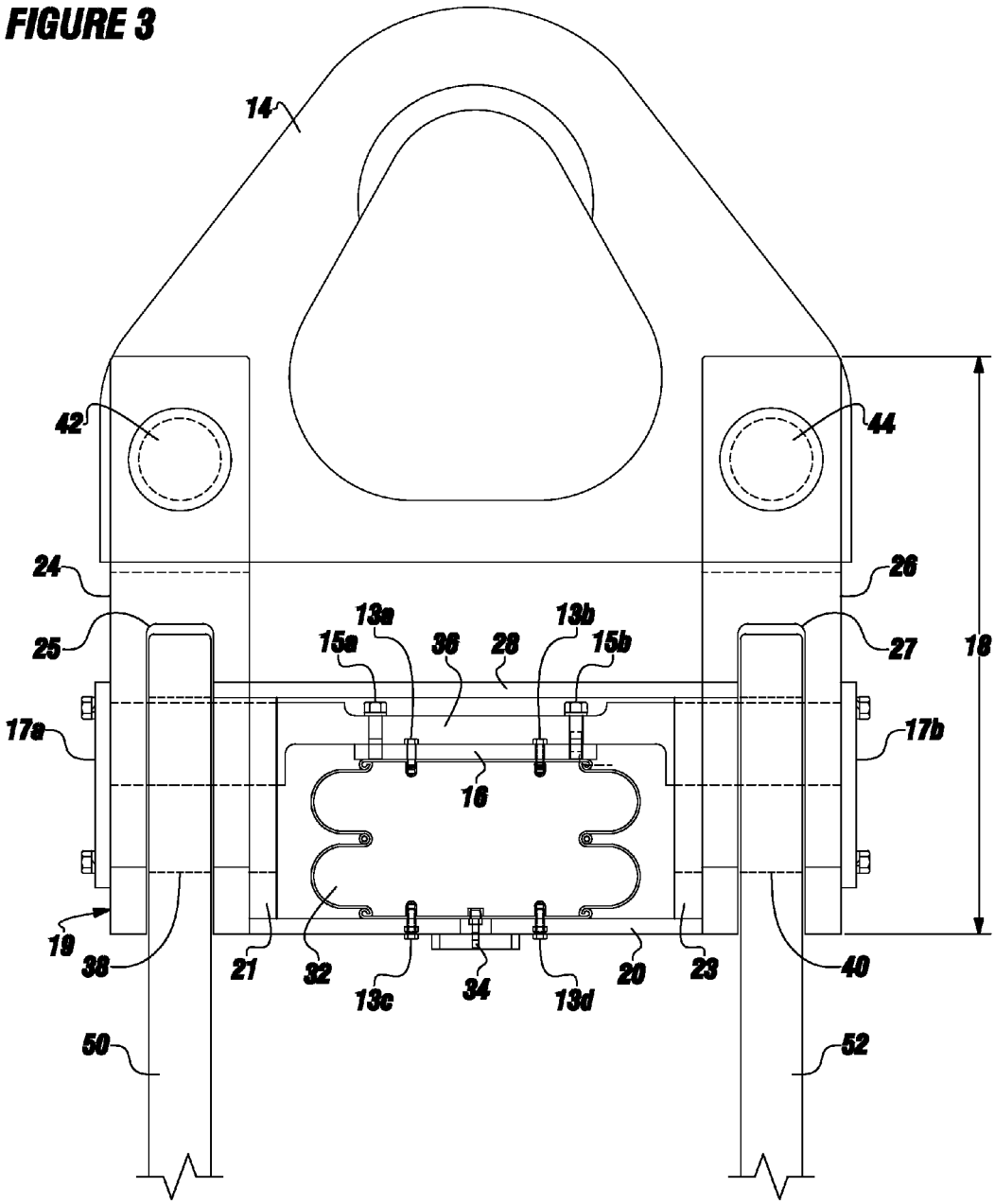
FIG. 3 depicts an embodiment of an airlift thread compensator.

FIG. 3 depicts an embodiment of the airlift thread compensator 18 with the airlift enclosure 19. The airlift enclosure 19 can include: an airlift enclosure bottom 20; a top enclosure side 28; a first enclosure side, here shown as a first double clevis 24 with a first plate 21; and a second enclosure side, here shown as a second double clevis 26 with a second plate 23.

The first double clevis 24 can include a first pin slot 38, and the second double clevis 26 can include a second pin slot 40. The bail pin 36 can be movably engaged within the first pin slot 38 and the second pin slot 40. The bail pin 36 can extend from the first double clevis 24 to the second double clevis 26 beneath the top enclosure side 28.

The airbag 32 can include an inflator valve 34, and can be connected to the airlift enclosure bottom 20 and to the bail pin 36. For example bolts 15*a* and 15*b* can attach the bail pin 36 to an airbag plate 16. Bolts 13*a* and 13*b* can connect the airbag plate 16 to the airbag 32, and bolts 13*c* and 13*d* can connect the airbag 32 to the airlift enclosure bottom 20.

The airlift thread compensator 18 can include a first retainer plate 17*a* disposed over the first pin slot 38 and connected to the first double clevis 24. The airlift thread compensator 18 can include a second retainer plate 17*b* disposed over the second pin slot 40 and connected to the second double clevis 26.

The first double clevis 24 can include a first link slot 25. The second double clevis 26 can include a second link slot 27. The bail pin 36 can extend from within the first pin slot 38, through the first link slot 25, through the second link slot 27, and into the second pin slot 40. The first upper link 50 can be slidably engaged within the first link slot 25, and the second upper link 52 can be slidably engaged within the second link slot 27. Also shown are the first pin 42, the second pin 44, and the bail 14.

Figure 4B:
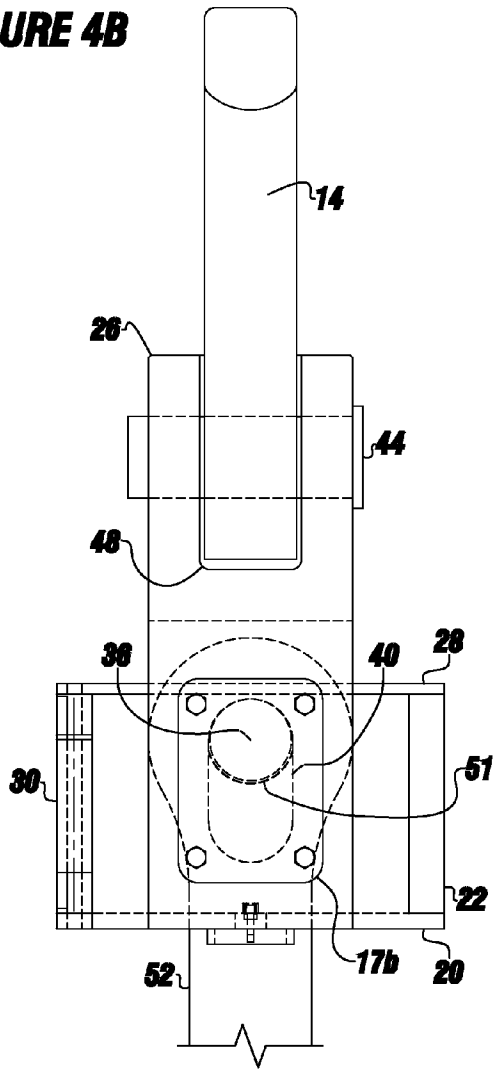
FIGS. 4A and 4B depict embodiments a double clevis with a bail pin disposed therethrough.
Figure 4A:
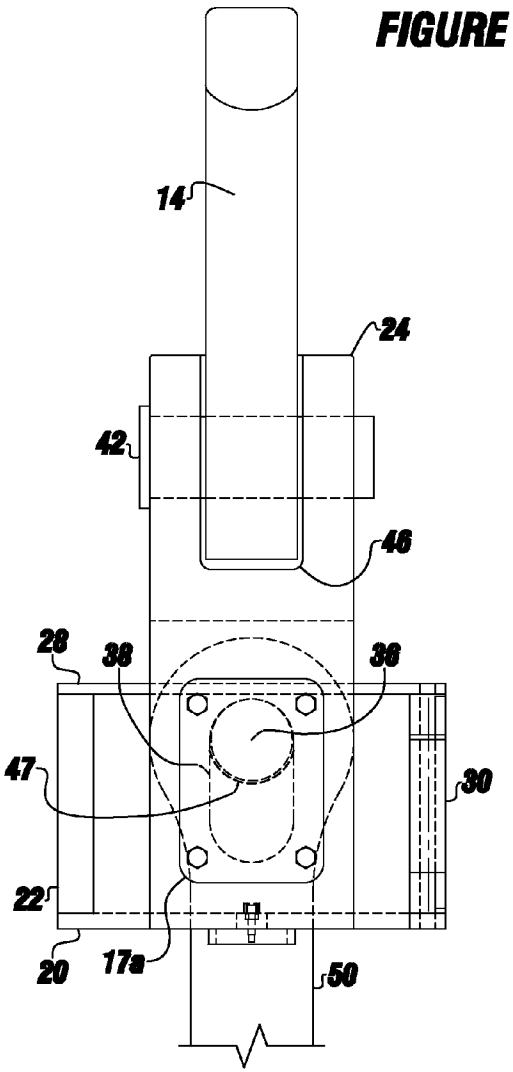

FIG. 4A depicts a side view of the first double clevis 24. The first pin slot 38 is shown with the bail pin 36 engaged therein. A first bail slot 46 is shown engaged with the bail 14 with the first pin 42. The bail pin 36 is also shown engaged through a hole 47 within the first upper link 50. The first retainer plate 17*a* is shown disposed over the first pin slot 38. Also depicted is the top enclosure side 28 disposed over and connected to the rear enclosure side 22 and the door 30. The airlift enclosure bottom 20 is shown connected to the rear enclosure side 22 and the door 30 opposite the top enclosure side 28.

FIG. 4B depicts a side view of the second double clevis 26. The second pin slot 40 is shown with the bail pin 36 engaged therein. A second bail slot 48 is shown engaged with the bail 14 with the second pin 44. The bail pin 36 is also shown engaged through a hole 51 within the second upper link 52. The second retainer plate 17*b* is shown disposed over the first pin slot 40. Also depicted is the top enclosure side 28 disposed over and connected to the rear enclosure side 22 and the door 30. The airlift enclosure bottom 20 is shown connected to the rear enclosure side 22 and the door 30 opposite the top enclosure side 28.

Figure 5A:
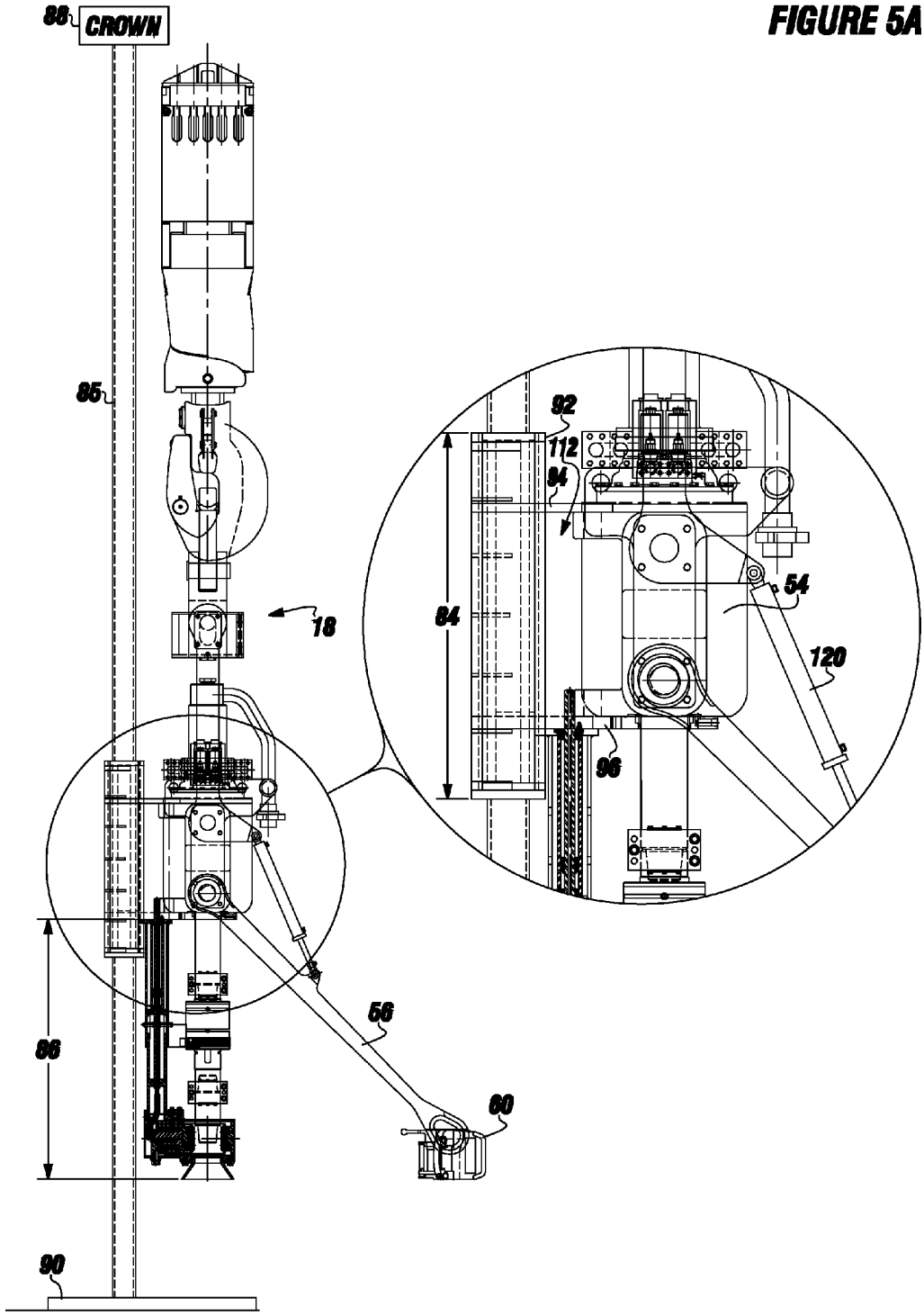

FIG. 5A depicts details of portions of the top drive. The top drive can include a torque wrench assembly 86 that can be connected to the top drive housing 54 or to a torque slide assembly 84. The torque slide assembly 84 can be configured to slide on a torque track 85. The torque track 85 can be suspended from a crown 88 of a derrick, and can be connected to a rig floor 90, or to a rig floor substructure.

The torque slide assembly 84 can include a slide body 92, a top plate 94 engaged with the top drive housing 54, and a bottom plate 96 engaged with the top drive housing 54. A first protected area 112 can be formed between the torque slide assembly 84 and the top drive housing 54.

The top drive can include an elevator hydraulic cylinder 120 connected to the elevator 60 and to the top drive housing 54 for kicking out the elevator 60 with the lower links, such as lower link 56, to grab tubulars. Also depicted is the airlift thread compensator 18.

FIG. 5B depicts a top view of the torque slide assembly 84. The first protected area 112 can be seen. A rotatable slide door 98 can be used for engagement around a rectangular torque reaction tube 100. The rotatable slide door 98 can provide for easy access to the rectangular torque reaction tube 100.

FIG. 5C depicts a view of a portion of the top drive. Solenoid valves 126 can be mounted within the first protected area 112, and connected to a control panel 127 for operating the top drive. A hydraulic power unit 129 can be in communication with the control panel 127 for powering the top drive. The hydraulic power unit 129 can be built into a transportable shipping container 130.

Figure 6:
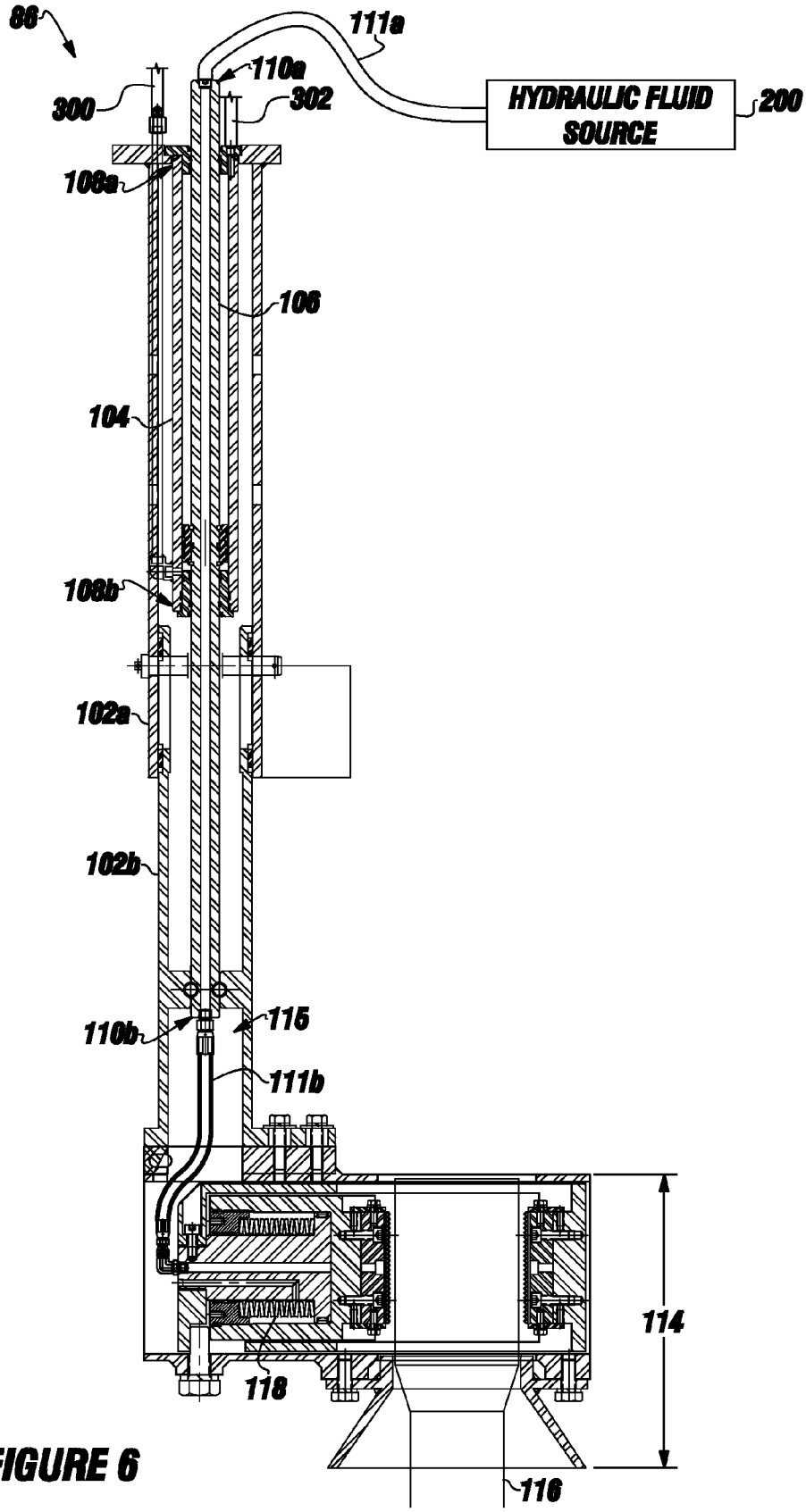
FIG. 6 depicts a detail of the torque wrench assembly.

FIG. 6 depicts a detailed view of the torque wrench assembly 86. The torque wrench assembly 86 can include a pair of torque supporting telescoping rectangular tubes 102*a* and 102*b* for supporting a load with only telescoping movement. A hydraulic cylinder 104 with a first end 108*a*, a second end 108*b*, and a single hollow cylinder rod 106 can be disposed inside the torque supporting telescoping rectangular tubes (102*a*, 102*b*). The single hollow cylinder rod 106 can be movably positionable to extend out each end (108*a*, 108*b*) of the hydraulic cylinder 104. The single hollow cylinder rod 106 can be connected to the lower torque supporting telescoping rectangular tube 102*b*. A first end 110*a* of the single hollow cylinder rod 106 can extend into the first protected area (as depicted in FIG. 5A). The first end 110*a* of the single hollow cylinder rod 106 can be connected to a top flexible conduit 111*a* which can be in fluid communication with a hydraulic fluid source 200.

The torque wrench assembly 86 can include a hydraulically operable torque wrench head 114 that can be hydraulically connected to a second end 110*b* of the single hollow cylinder rod 106 via a bottom flexible conduit 111*b*. The hydraulically operable torque wrench head 114 can be adapted to grip tubulars, such as tubular 116.

A second protected area 115 can be formed within the pair of torque supporting telescoping rectangular tubes (102*a*, 102*b*), the torque wrench assembly 86, or combinations thereof. The second end 110*b* of the single hollow cylinder rod 106, connected to the bottom flexible conduit 111*b*, can extend into the second protected area 115.

The torque wrench assembly 86 can include a set of springs 118 in the hydraulically operable torque wrench head 114 for disengaging the hydraulically operable torque wrench head 114 from the tubular 116.

The hydraulic cylinder 104 can be in fluid communication through conduits 300 and 302 with a hydraulic fluid source.

FIGS. 7A, 7B, 7C, 7D, and 7E depict the top drive 10 in various modes of operation.

Figure 7A:
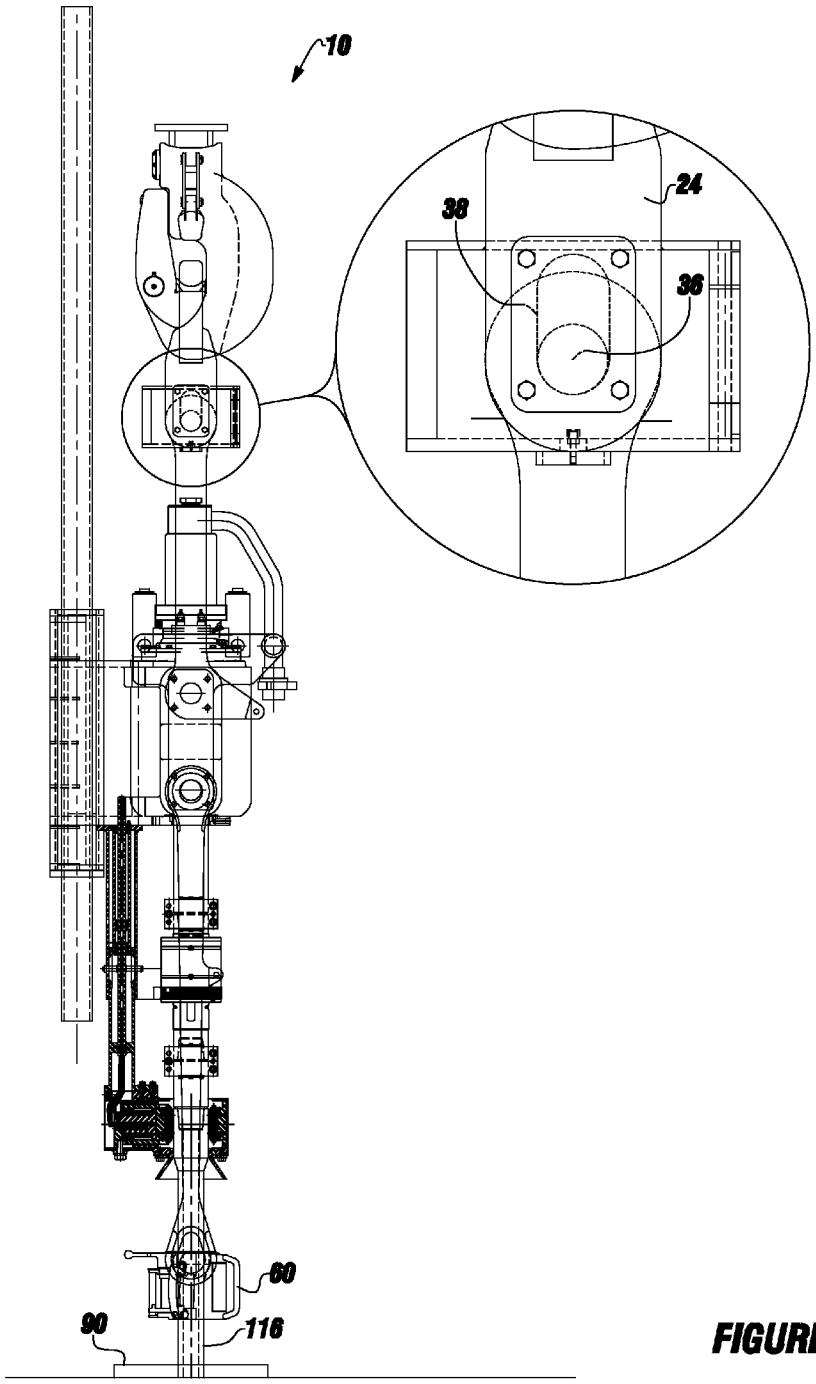
FIGS. 7A-7E depict the top drive in various modes of operation.

FIG. 7A depicts the top drive 10 being used to drill in a well bore. As shown, the weight of the top drive 10 is transferred to the bail pin 36. The bail pin 36 is disposed in a first position within the first pin slot 38 (and within the second pin slot not shown), wherein the bail pin 36 is engaged with the first double clevis 24 (and the second double clevis not shown) at a bottom of the first pin slot 38. With the bail pin 36 in the first position, the weight of the top drive 10 can be directly transferred to the each double clevis, as the bail pin 36 can rest on each double clevis within each pin slot. Also, with the bail pin 36 in the first position, the airbag can be at a high pressure, as it is compressed by the weight of the top drive 10 with the additional weight of the tubular 116 during drilling. As depicted, the top drive 10 is shown drilling through the elevator 60, with the elevator 60 disposed proximate the rig floor 90.

Figure 7B:
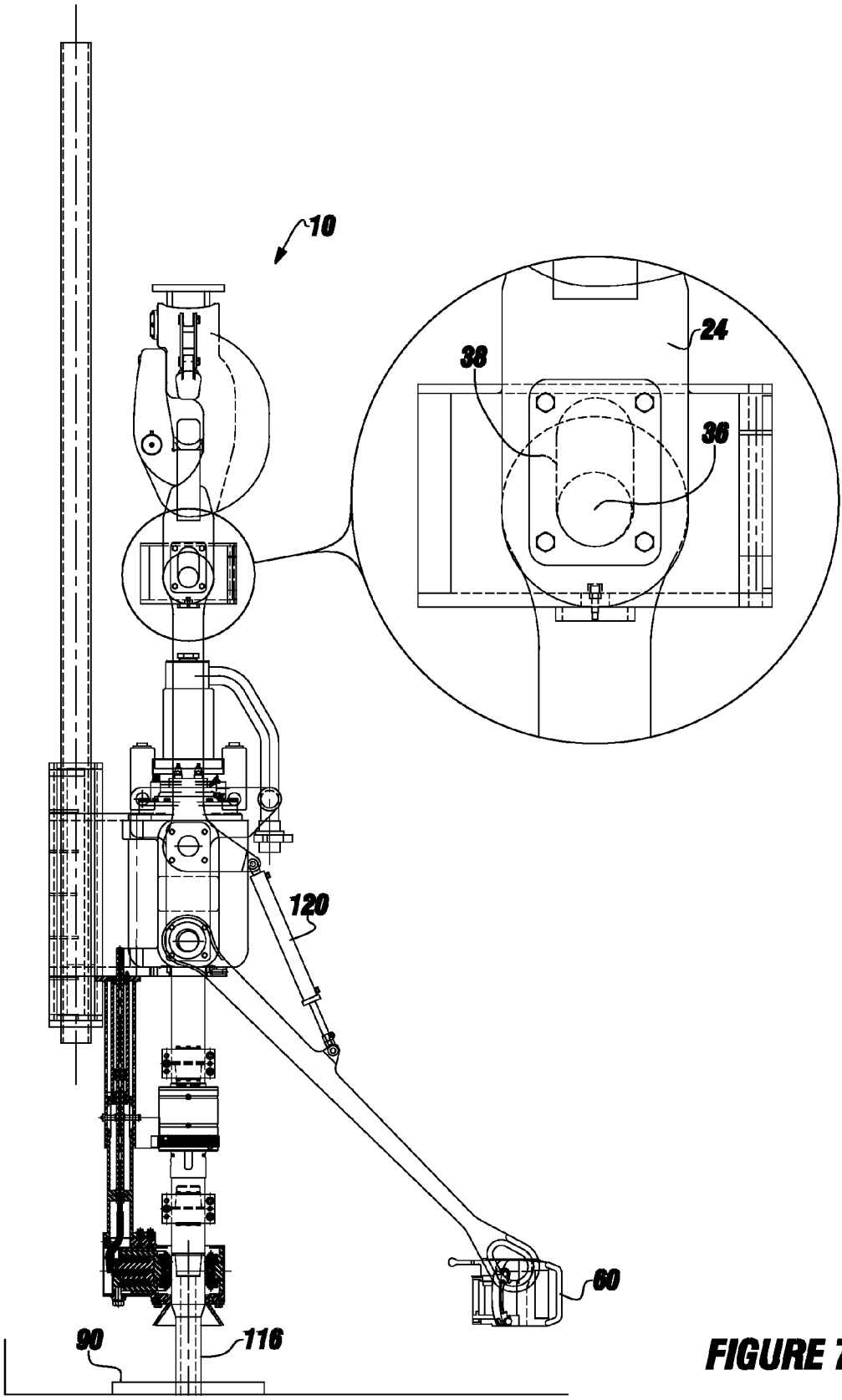

FIG. 7B depicts the top drive 10 attached to the tubular 116 during drilling at the rig floor 90, wherein the elevator 60 is in a kicked out position. The elevator 60 can be brought to the kicked out position using the hydraulic cylinder 120. As shown, the weight of the top drive 10 is transferred to the bail pin 36. The bail pin 36 is disposed in the first position within the first pin slot 38 (and within the second pin slot not shown), wherein the bail pin 36 is engaged with the first double clevis 24 (and the second double clevis not shown) at a bottom of the first pin slot 38.

Figure 7C:
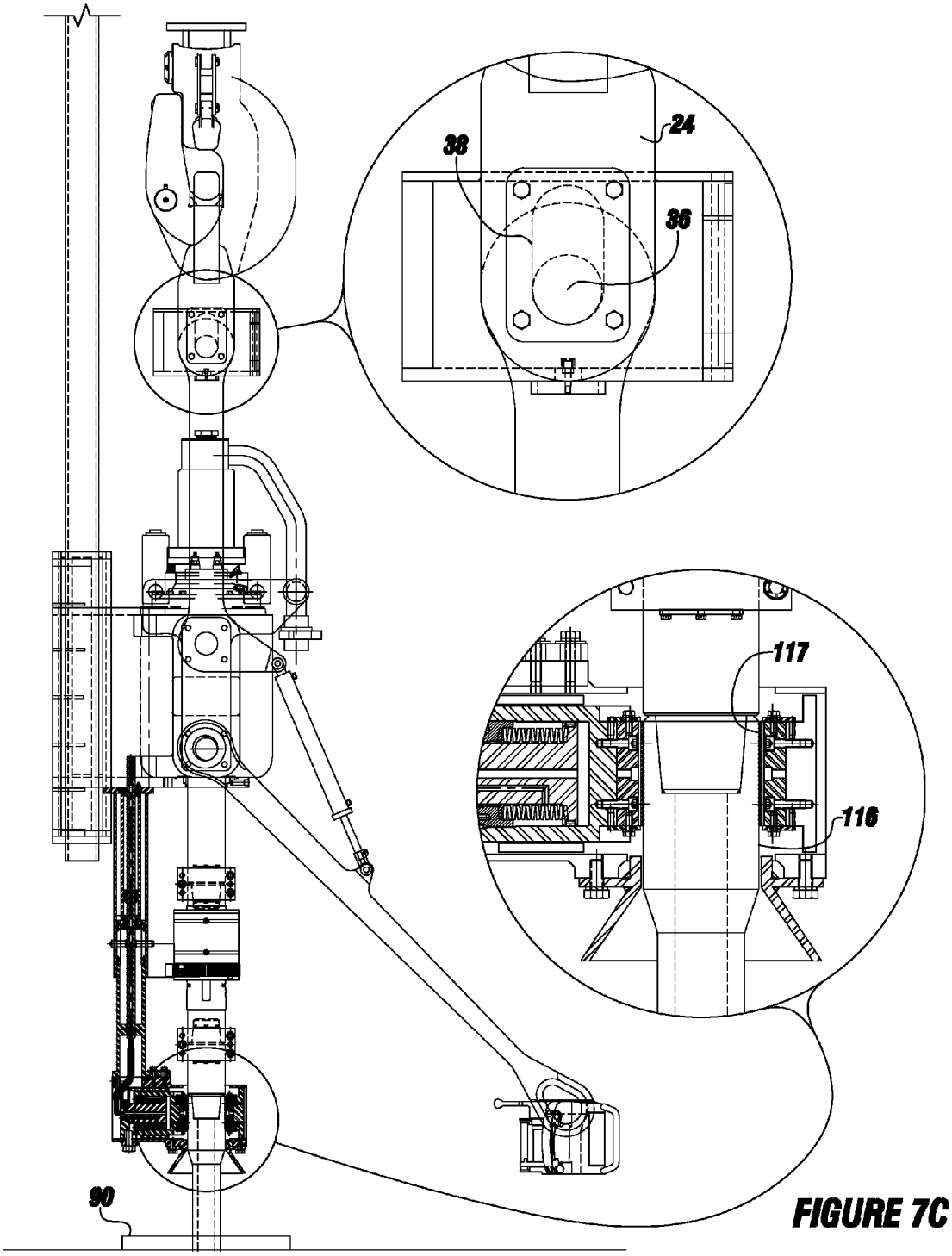

FIG. 7C depicts a grabber 117 of the hydraulically operable torque wrench closed about and engaged with the tubular 116. The grabber 117 can be used to grab the tubular during threadable engagement or threadable disengagement of the tubular 116 with the saver sub. As shown, the weight of the top drive 10 is transferred to the bail pin 36. The bail pin 36 is disposed in the first position within the first pin slot 38 (and within the second pin slot not shown), wherein the bail pin 36 is engaged with the first double clevis 24 (and the second double clevis not shown) at a bottom of the first pin slot 38. Also depicted is the rig floor 90.

Figure 7D:
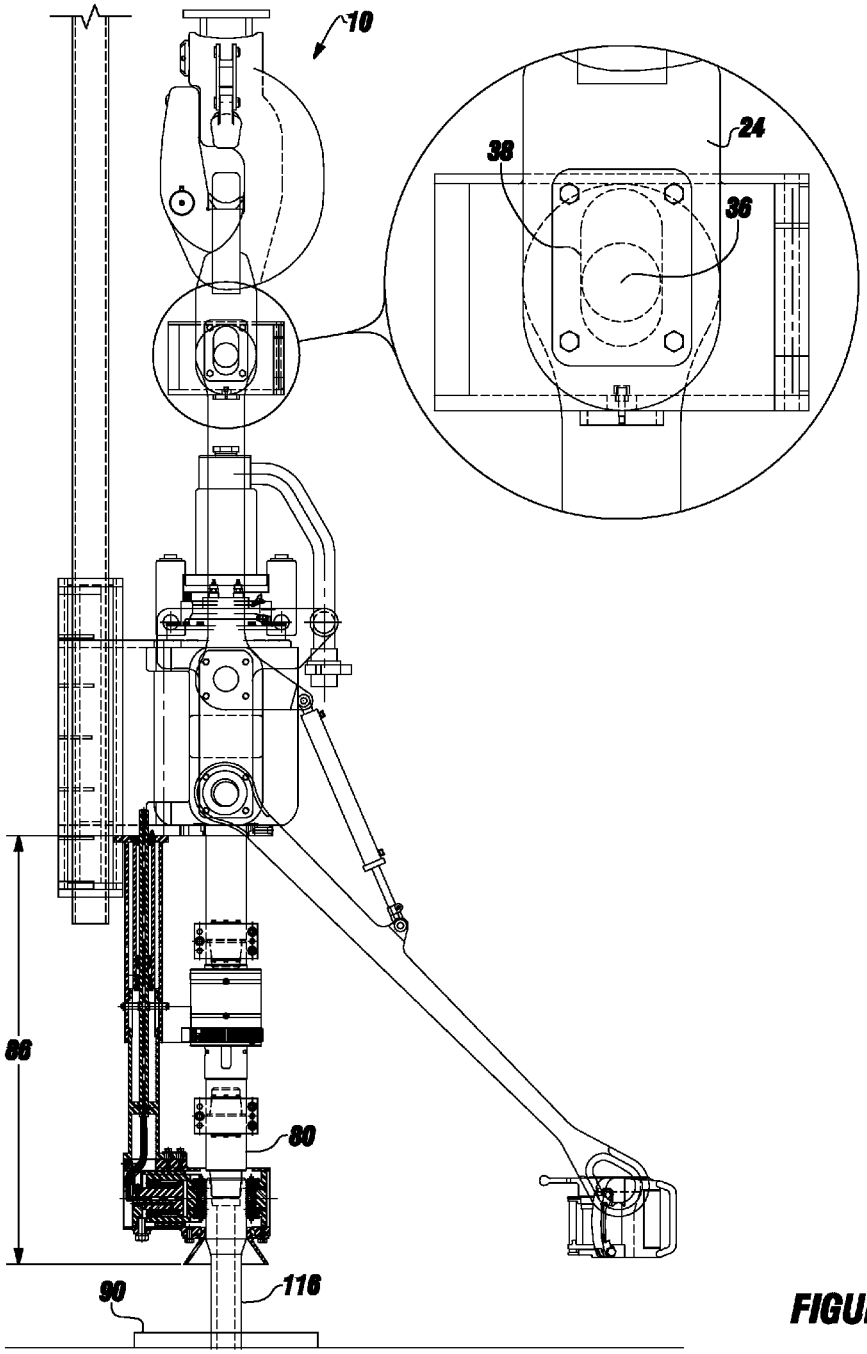

FIG. 7D depicts the position of the bail pin 36 when the torque wrench assembly 86 is being used to threadably engage or disengage the tubular 116 from the saver sub 80. Threadable disengagement of the tubular 116 from the saver sub 80 is also herein referred to as breaking out.

The weight of the top drive 10 is transferred to the bail pin 36. The bail pin 36 is disposed in a second position within the first pin slot 38 (and within the second pin slot not shown), wherein the bail pin 36 is disengaged from the bottom of the first pin slot of the first double clevis 24 (and the second double clevis not shown) and is disposed above the bottom of the first pin slot 38. With the bail pin 36 in the second position, the weight of the top drive 10 is not directly transferred to either double clevis, but is instead transferred to directly to the airbag only.

The airbag can be at a preset pressure. The preset pressure can be specifically selected by an operator, such that the preset pressure can support and suspend the weight of the top drive. For example, during drilling operations, as is depicted in FIGS. 7A-7C, the bail pin 36 can engage against each double clevis within the pin slots and can transfer the weight of the top drive 10 and the tubular 116 connected thereto to each double clevis. The preset pressure can be selected such that during breakout of the tubular 116 from the saver sub 80 the airbag can lift the top drive 10 using the bail pin 36 attached thereto. The preset pressure can be selected such that the airbag lifts the top drive 10 and the bail pin 36 to a preselected position, such as the second position. The preset pressure can be sufficient to lift the top drive at least enough to separate threads of the tubular 116 from threads of the saver sub 80. The air pressure within the airbag can be sufficient to support and suspend the weight of the entire top drive 10 when the top drive is disconnected from the tubular 116. Also depicted is the rig floor 90.

Figure 7E:
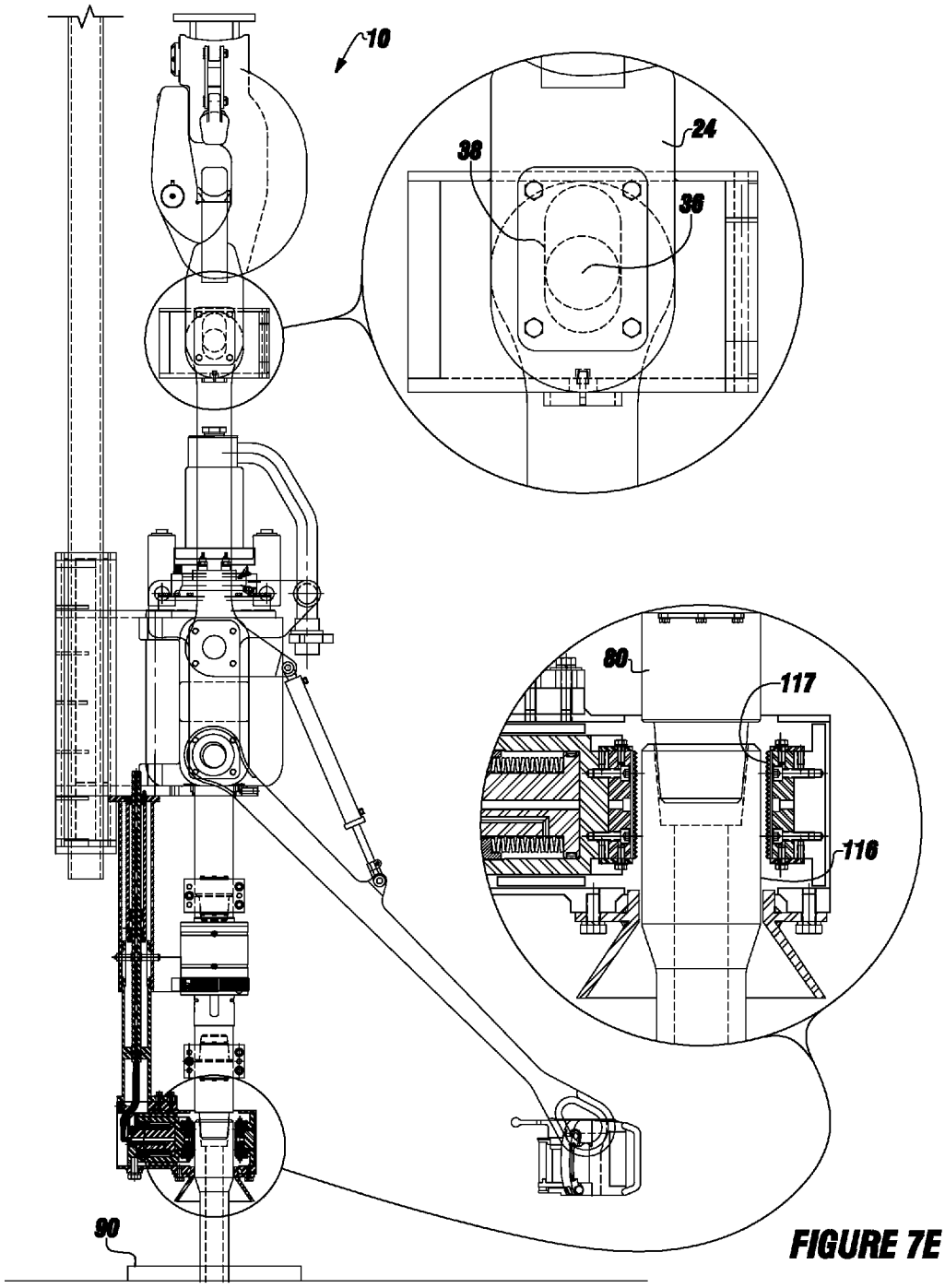

FIG. 7E depicts an embodiment wherein the saver sub 80 has been disengaged or broken out from the tubular 116. The saver sub 80 is shown at least partially separated from the tubular 116. After breaking out the tubular 116, the gripper 117 can be disengaged from the tubular 116, as here shown.

The weight of the top drive 10 is transferred to the bail pin 36, which is disposed in the second position within the first pin slot 38 (and within the second pin slot not shown), wherein the bail pin 36 is disengaged from the bottom of the first pin slot of the first double clevis 24 (and the second double clevis not shown) and is disposed above the bottom of the first pin slot 38. Also depicted is the rig floor 90.

Figure 8:
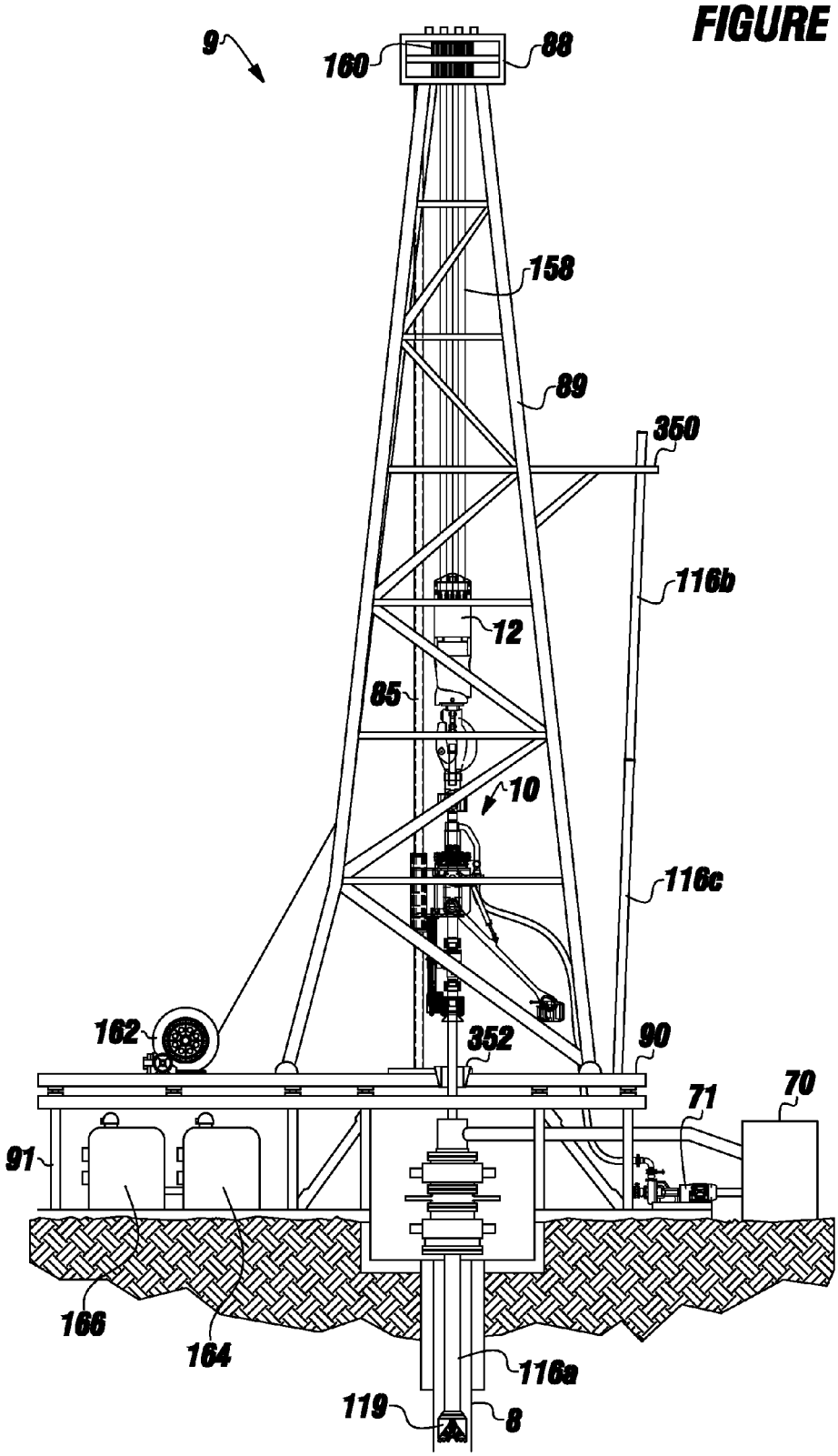
FIG. 8 depicts the top drive mounted to a drilling rig.

FIG. 8 depicts a drilling rig 9 with a derrick 89. The drilling rig 9 can include a rig floor 90 and a rig floor substructure 91. The traveling block with the hook 12 can be secured to a cable 158. The cable 158 can extend from the traveling block with hook 12 over at least one sheave 160 mounted to a top of the derrick 89 at a crown 88. The cable 158 can be connected to a drawworks 162. The drawworks 162 can be connected to a drawworks motor 164 for turning the drawworks 162, and for raising or lowering the traveling block with the hook 12. The drawworks motor 164 can be energized from a power supply 166. The top drive 10 can be slidingly engaged on the torque track 85 and removably affixed to the traveling block with the hook 12.

The tubular 116*a* can be engaged with the top drive 10 at one end, and with a drill bit 119 on the other end.

Also depicted is a stand of tubulars, including tubular 116*b* and 116*c*, which can be stacked in a racking position 350 on the rig floor 90.

The slips 352 of the drilling rig 9 can also be seen.

FIGS. 9A-9G depict an embodiment of a method for using a top drive having an airlift thread compensator and a hollow cylinder rod for providing minimum flexing of conduits.

Figure 9A:
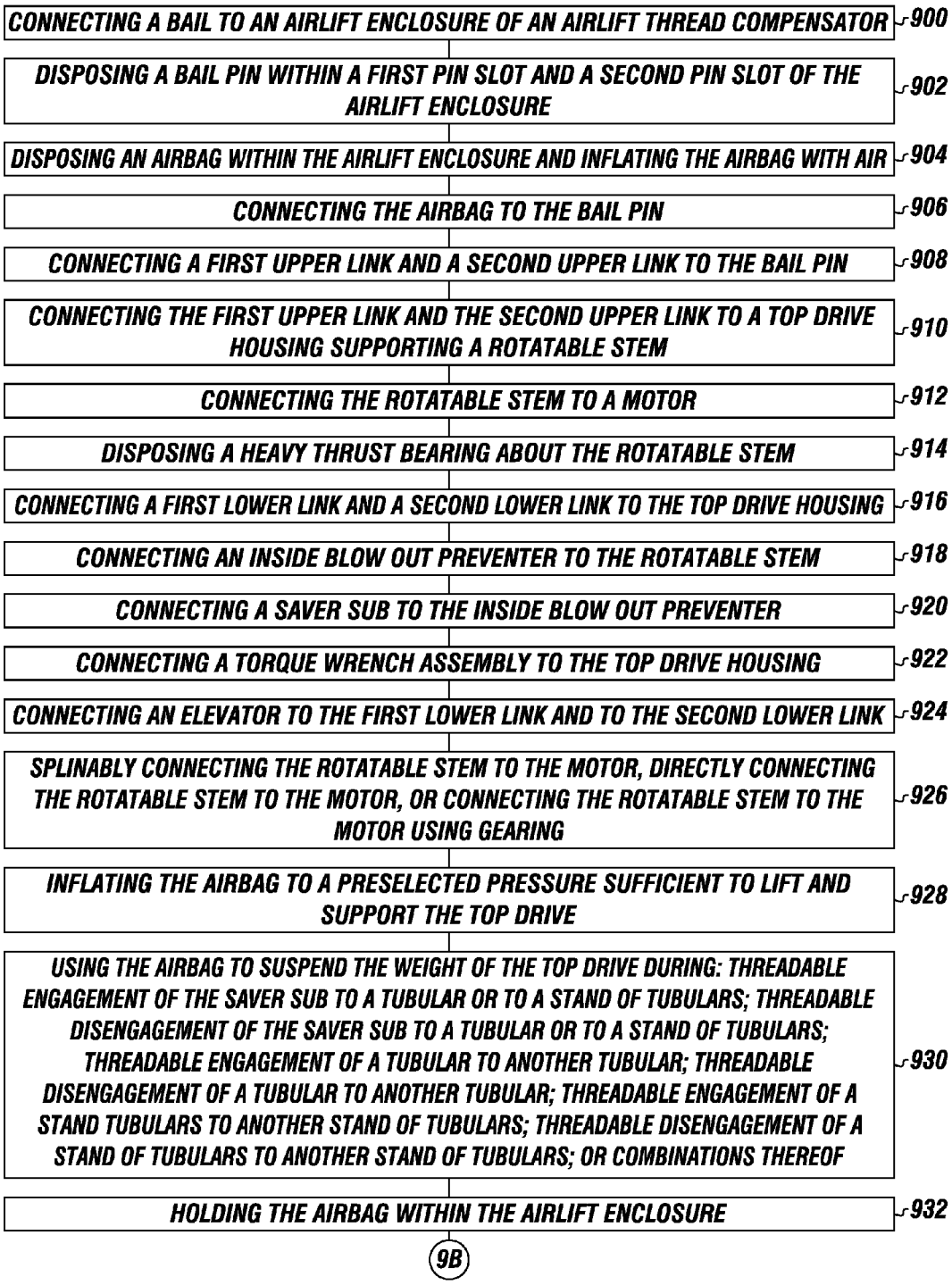

FIG. 9A shows that the method can include connecting a bail to an airlift enclosure of an airlift thread compensator, as illustrated by box 900.

The method can include disposing a bail pin within a first pin slot and a second pin slot of the airlift enclosure, as illustrated by box 902.

The method can include disposing an airbag within the airlift enclosure and inflating the airbag with air, as illustrated by box 904.

The method can include connecting the airbag to the bail pin, as illustrated by box 906.

The method can include connecting a first upper link and a second upper link to the bail pin, as illustrated by box 908.

The method can include connecting the first upper link and the second upper link to a top drive housing supporting a rotatable stem, as illustrated by box 910.

The method can include connecting the rotatable stem to a motor, as illustrated by box 912.

The method can include disposing a heavy thrust bearing about the rotatable stem, as illustrated by box 914.

The method can include connecting a first lower link and a second lower link to the top drive housing, as illustrated by box 916.

The method can include connecting an inside blow out preventer to the rotatable stem, as illustrated by box 918.

The method can include connecting a saver sub to the inside blow out preventer, as illustrated by box 920.

The method can include connecting a torque wrench assembly to the top drive housing, as illustrated by box 922.

The method can include connecting an elevator to the first lower link and to the second lower link, as illustrated by box 924.

The method can include splinably connecting the rotatable stem to the motor, directly connecting the rotatable stem to the motor, or connecting the rotatable stem to the motor using gearing, as illustrated by box 926.

The method can include inflating the airbag to a preselected pressure sufficient to lift and support the top drive, as illustrated by box 928.

The method can include using the airbag to suspend the weight of the top drive during: threadable engagement of the saver sub to a tubular or to a stand of tubulars; threadable disengagement of the saver sub to a tubular or to a stand of tubulars; threadable engagement of a tubular to another tubular; threadable disengagement of a tubular to another tubular; threadable engagement of a stand tubulars to another stand of tubulars; threadable disengagement of a stand of tubulars to another stand of tubulars; or combinations thereof, as illustrated by box 930.

The method can include holding the airbag within the airlift enclosure, as illustrated by box 932.

Figure 9B:
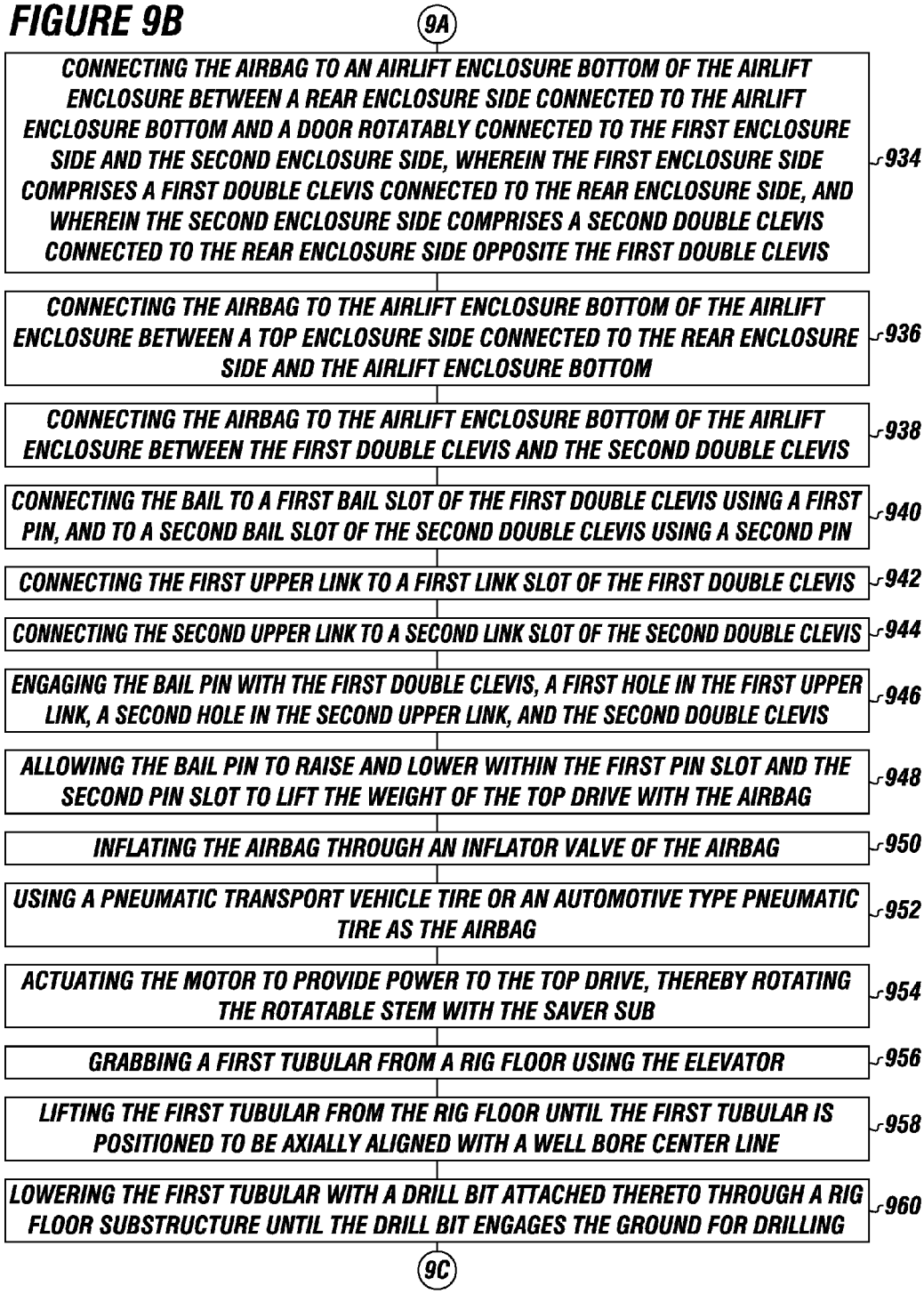

FIG. 9B is a continuation of FIG. 9A. The method can include connecting the airbag to an airlift enclosure bottom of the airlift enclosure between a rear enclosure side connected to the airlift enclosure bottom and a door rotatably connected to the first enclosure side and the second enclosure side, wherein the first enclosure side comprises a first double clevis connected to the rear enclosure side, and wherein the second enclosure side comprises a second double clevis connected to the rear enclosure side opposite the first double clevis, as illustrated by box 934.

The method can include connecting the airbag to the airlift enclosure bottom of the airlift enclosure between a top enclosure side connected to the rear enclosure side and the airlift enclosure bottom, as illustrated by box 936.

The method can include connecting the airbag to the airlift enclosure bottom of the airlift enclosure between the first double clevis and the second double clevis, as illustrated by box 938.

The method can include connecting the bail to a first bail slot of the first double clevis using a first pin, and to a second bail slot of the second double clevis using a second pin, as illustrated by box 940.

The method can include connecting the first upper link to a first link slot of the first double clevis, as illustrated by box 942.

The method can include connecting the second upper link to a second link slot of the second double clevis, as illustrated by box 944.

The method can include engaging the bail pin with the first double clevis, a first hole in the first upper link, a second hole in the second upper link, and the second double clevis, as illustrated by box 946.

The method can include allowing the bail pin to raise and lower within the first pin slot and the second pin slot to lift the weight of the top drive with the airbag, as illustrated by box 948.

The method can include inflating the airbag through an inflator valve of the airbag, as illustrated by box 950.

The method can include using a pneumatic transport vehicle tire or an automotive type pneumatic tire as the airbag, as illustrated by box 952.

The method can include actuating the motor to provide power to the top drive, thereby rotating the rotatable stem with the saver sub, as illustrated by box 954.

The method can include grabbing a first tubular from a rig floor using the elevator, as illustrated by box 956.

The method can include lifting the first tubular from the rig floor until the first tubular is positioned to be axially aligned with a well bore center line, as illustrated by box 958.

The method can include lowering the first tubular with a drill bit attached thereto through a rig floor substructure until the drill bit engages the ground for drilling, as illustrated by box 960.

Figure 9C:
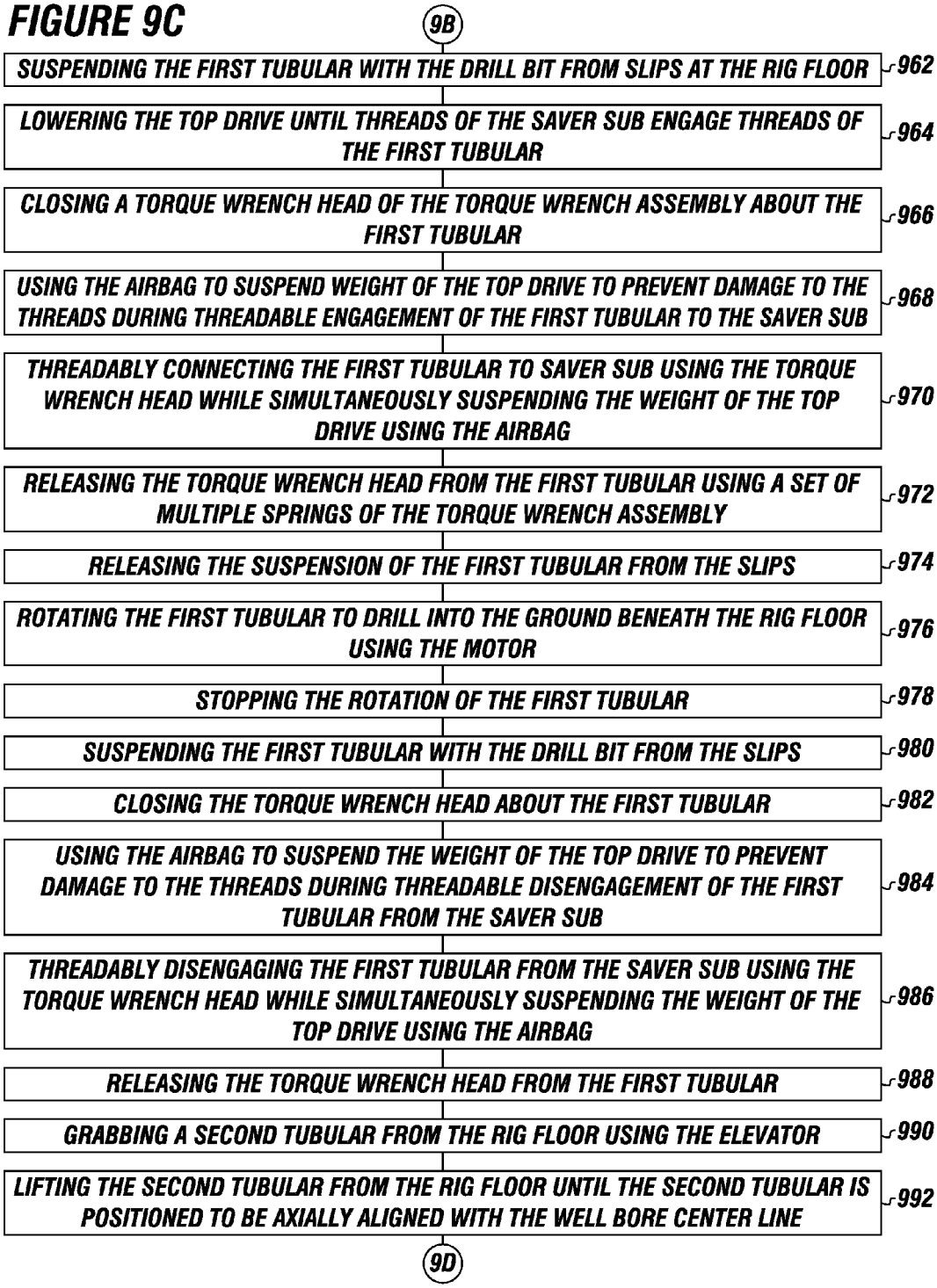

FIG. 9C is a continuation of FIG. 9B. The method can include suspending the first tubular with the drill bit from slips at the rig floor, as illustrated by box 962.

The method can include lowering the top drive until threads of the saver sub engage threads of the first tubular, as illustrated by box 964.

The method can include closing a torque wrench head of the torque wrench assembly about the first tubular, as illustrated by box 966.

The method can include using the airbag to suspend weight of the top drive to prevent damage to the threads during threadable engagement of the first tubular to the saver sub, as illustrated by box 968.

The method can include threadably connecting the first tubular to saver sub using the torque wrench head while simultaneously suspending the weight of the top drive using the airbag, as illustrated by box 970.

The method can include releasing the torque wrench head from the first tubular using a set of multiple springs of the torque wrench assembly, as illustrated by box 972.

The method can include releasing the suspension of the first tubular from the slips, as illustrated by box 974.

The method can include rotating the first tubular to drill into the ground beneath the rig floor using the motor, as illustrated by box 976.

The method can include stopping the rotation of the first tubular, as illustrated by box 978.

The method can include suspending the first tubular with the drill bit from the slips, as illustrated by box 980.

The method can include closing the torque wrench head about the first tubular, as illustrated by box 982.

The method can include using the airbag to suspend the weight of the top drive to prevent damage to the threads during threadable disengagement of the first tubular from the saver sub, as illustrated by box 984.

The method can include threadably disengaging the first tubular from the saver sub using the torque wrench head while simultaneously suspending the weight of the top drive using the airbag, as illustrated by box 986.

The method can include releasing the torque wrench head from the first tubular, as illustrated by box 988.

The method can include grabbing a second tubular from the rig floor using the elevator, as illustrated by box 990.

The method can include lifting the second tubular from the rig floor until the second tubular is positioned to be axially aligned with the well bore center line, as illustrated by box 992.

FIG. 9D is a continuation of FIG. 9C. The method can include lowering the second tubular through the rig floor substructure until threads of the second tubular engage the threads of the first tubular, as illustrated by box 994.

The method can include lowering the top drive until the threads of the saver sub engage threads of the second tubular, as illustrated by box 996.

The method can include using the airbag to suspend weight of the top drive to prevent damage to the threads during threadable engagement of the second tubular to the saver sub and to the first tubular, as illustrated by box 998.

The method can include threadably connecting the second tubular to saver sub and to the first tubular using the top drive while simultaneously suspending the weight of the top drive using the airbag, as illustrated by box 1000.

The method can include releasing the suspension of the first tubular with the drill bit from slips, as illustrated by box 1002.

The method can include rotating the connected tubulars to drill in the ground beneath the rig floor using the motor, as illustrated by box 1004.

The method can include repeating the steps described in boxes 978-1004 as more tubulars are required for drilling into the ground, as illustrated by box 1006.

The method can include pulling out of the well bore, as illustrated by box 1008.

The method can include stopping rotation of the connected tubulars to cease drilling in the ground beneath the rig floor, as illustrated by box 1010.

The method can include raising the connected tubulars until a connection of the tubulars is positionable to hang from the slips, as illustrated by box 1012.

The method can include hanging the connected tubulars from the slips, as illustrated by box 1014.

The method can include using the airbag to suspend the weight of the top drive to prevent damage to threads of the connected tubulars, as illustrated by box 1016.

The method can include threadably disconnecting a portion of the connected tubulars, forming a stand of tubulars, while simultaneously suspending the weight of the top drive using the airbag, as illustrated by box 1018.

The method can include breaking out and unscrewing the stand of tubulars from the saver sub using the torque wrench head, as illustrated by box 1020.

The method can include manually breaking out the stand of tubulars from the remaining connected tubulars suspended from the slips, as illustrated by box 1022.

FIG. 9E is a continuation of FIG. 9D. The method can include using the elevator to move the stand of tubulars to a racking position on the rig floor, as illustrated by box 1024.

The method can include repeating the steps described in boxes 1010-1024 until all connected tubulars are out of the well bore, as illustrated by box 1026.

The method can include tripping back into the well bore, as illustrated by box 1028.

The method can include using the elevator to lift a first stand of tubulars from the racking position, as illustrated by box 1030.

The method can include using the elevator to lower the first stand of tubulars into the well bore and to hang the first stand of tubulars from the slips, as illustrated by box 1032.

The method can include using the elevator to lift a second stand of tubulars from the racking position, as illustrated by box 1034.

The method can include using the elevator to lower the second stand of tubulars into engagement with the first stand of tubulars, as illustrated by box 1036.

The method can include using the airbag to suspend the weight of the top drive, as illustrated by box 1038.

The method can include threadably connecting the second stand of tubulars to the first stand of tubulars and to the saver sub by: manually screwing the second stand of tubulars to the first stand of tubulars; and screwing the second stand of tubulars to the saver sub using the torque wrench head while simultaneously suspending the weight of the top drive using the airbag, as illustrated by box 1040.

The method can include repeating the steps described in boxes 1030-1040 until all stands of tubulars are connected and disposed within the well bore, as illustrated by box 1042.

The method can include actuating the motor to provide power to the top drive, thereby rotating the rotatable stem and the connected stands of tubulars with the saver sub to drill in the well bore, as illustrated by box 1044.

The method can include suspending a torque track from a crown of the derrick and connecting the torque track to the rig floor or to the rig floor substructure, as illustrated by box 1046.

The method can include slidably attaching a torque slide assembly to the torque track, as illustrated by box 1048.

The method can include engaging a top plate of the torque slide assembly with the top drive housing, as illustrated by box 1050.

The method can include engaging a bottom plate of the torque slide assembly with the top drive housing, as illustrated by box 1052.

The method can include engaging a rotatable slide door around a rectangular torque reaction tube of the torque slide assembly, as illustrated by box 1054.

FIG. 9F is a continuation of FIG. 9E. The method can include positioning the torque wrench assembly along at least one tubular for threadably connecting or disconnecting the tubular to the saver sub using a hydraulic cylinder, as illustrated by box 1056.

The method can include connecting a first end of the single hollow cylinder rod to a top flexible conduit in fluid communication with a hydraulic fluid source for receiving hydraulic fluid, as illustrated by box 1058.

The method can include movably positioning the first end of the single hollow cylinder rod to extend out of the first end of the hydraulic cylinder into a first protected area between the torque slide assembly and the top drive housing, as illustrated by box 1060.

The method can include connecting a second end of the single hollow cylinder rod to a bottom flexible conduit in fluid communication with the torque wrench head for providing hydraulic fluid to the torque wrench head from the hydraulic fluid source, as illustrated by box 1062.

The method can include movably positioning the second end of the single hollow cylinder rod connected to the bottom flexible conduit such that the second end of the single hollow cylinder rod extends out of the second end of the hydraulic cylinder and into a second protected area within the pair of torque supporting telescoping rectangular tubes, the torque wrench assembly, or combinations thereof, wherein providing hydraulic fluid to the torque wrench head through the top flexible conduit and the single hollow cylinder rod prevents flexing and axial movement of the bottom flexible conduit, as illustrated by box 1064.

The method can include gripping at least one tubular using the torque wrench head before threadably connecting or disconnecting the tubular to another tubular or to the saver sub, as illustrated by box 1066.

The method can include supporting weight of the at least one tubular with only telescoping movement using the pair of torque supporting telescoping rectangular tubes while threadably connecting or disconnecting the tubular to another tubular or to the saver sub, while simultaneously suspending the weight of the top drive using the airbag, as illustrated by box 1068.

The method can include locking the connection of the inside blow out preventer to the rotatable stem using an upper clamp assembly, as illustrated by box 1070.

The method can include locking the connection of the inside blow out preventer to the saver sub using a lower clamp assembly, as illustrated by box 1072.

Figure 9G:
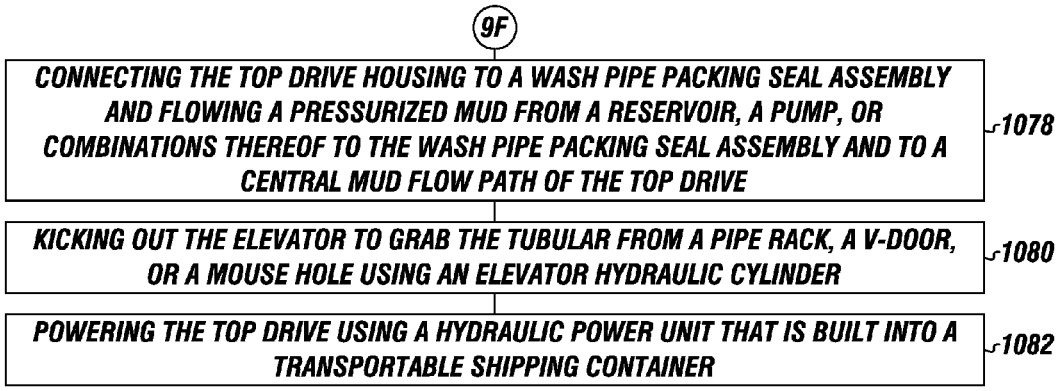

FIG. 9G is a continuation of FIG. 9F. The method can include connecting the top drive housing to a wash pipe packing seal assembly and flowing a pressurized mud from a reservoir, a pump, or combinations thereof to the wash pipe packing seal assembly and to a central mud flow path of the top drive, as illustrated by box 1078.

The method can include kicking out the elevator to grab the tubular from a pipe rack, a V-door, or a mouse hole using an elevator hydraulic cylinder, as illustrated by box 1080.

The method can include powering the top drive using a hydraulic power unit that is built into a transportable shipping container, as illustrated by box 1082.

While these embodiments have been described with emphasis on the embodiments, it should be understood that within the scope of the appended claims, the embodiments might be practiced other than as specifically described herein.

What is claimed is:

1. A method for using a top drive having an airlift thread compensator and a hollow cylinder rod for providing minimum flexing of conduits, the method comprising:

a. connecting a bail to an airlift enclosure of an airlift thread compensator having a first enclosure side with a first pin slot, and a second enclosure side with a second pin slot;

b. disposing a bail pin within the first pin slot and the second pin slot;

c. disposing an airbag within the airlift enclosure and inflating the airbag with air;

d. connecting the airbag to the bail pin;

e. connecting a first upper link and a second upper link to the bail pin;

f. connecting the first upper link and the second upper link to a top drive housing supporting a rotatable stem;

g. connecting the rotatable stem to a motor;

h. disposing a heavy thrust bearing about the rotatable stem;

i. connecting a first lower link and a second lower link to the top drive housing;

j. connecting an inside blow out preventer to the rotatable stem;

k. connecting a saver sub to the inside blow out preventer;

l. connecting a torque wrench assembly to the top drive housing; and m. connecting an elevator to the first lower link and to the second lower link.

2. The method of claim 1, wherein connecting the rotatable stem to the motor includes:

splinably connecting the rotatable stem to the motor, directly connecting the rotatable stem to the motor, or connecting the rotatable stem to the motor using gearing.

3. The method of claim 1, wherein the airbag is inflated to a preselected pressure sufficient to lift and support the top drive.

4. The method of claim 1, further comprising using the airbag to suspend the weight of the top drive during:

a. threadable engagement of the saver sub to a tubular or to a stand of tubulars;

b. threadable disengagement of the saver sub to a tubular or to a stand of tubulars;

c. threadable engagement of a tubular to another tubular;

d. threadable disengagement of a tubular to another tubular;

e. threadable engagement of a stand tubulars to another stand of tubulars;

f. threadable disengagement of a stand of tubulars to another stand of tubulars; or g. combinations thereof.

5. The method of claim 4, further comprising suspending the weight of the top drive with the airbag by:

a. holding the airbag within the airlift enclosure;

b. connecting the airbag to an airlift enclosure bottom of the airlift enclosure between:

(i) a rear enclosure side connected to the airlift enclosure bottom and a door rotatably connected to the first enclosure side and the second enclosure side, wherein the first enclosure side comprise a first double clevis connected to the rear enclosure side, and wherein the second enclosure side comprises a second double clevis connected to the rear enclosure side opposite the first double clevis;

(ii) a top enclosure side connected to the rear enclosure side and the airlift enclosure bottom; and (iii) the first double clevis and the second double clevis;

c. connecting the bail to a first bail slot of the first double clevis using a first pin, and to a second bail slot of the second double clevis using a second pin;

d. connecting the first upper link to a first link slot of the first double clevis;

e. connecting the second upper link to a second link slot of the second double clevis;

f. engaging the bail pin with the first double clevis, a first hole in the first upper link, a second hole in the second upper link, and the second double clevis; and g. allowing the bail pin to raise and lower within the first pin slot and the second pin slot to lift the weight of the top drive with the airbag.

6. The method of claim 1, further comprising inflating the airbag through an inflator valve of the airbag.

7. The method of claim 1, further comprising using a pneumatic transport vehicle tire or an automotive type pneumatic tire as the airbag.

8. The method of claim 1, further comprising:

a. actuating the motor to provide power to the top drive, thereby rotating the rotatable stem with the saver sub;

b. grabbing a first tubular from a rig floor using the elevator;

c. lifting the first tubular from the rig floor until the first tubular is positioned to be axially aligned with a well bore center line;

d. lowering the first tubular with a drill bit attached thereto through a rig floor substructure until the drill bit engages the ground for drilling;

e. suspending the first tubular with the drill bit from slips at the rig floor;

f. lowering the top drive until threads of the saver sub engage threads of the first tubular;

g. closing a torque wrench head of the torque wrench assembly about the first tubular;

h. using the airbag to suspend weight of the top drive to prevent damage to the threads during threadable engagement of the first tubular to the saver sub;

i. threadably connecting the first tubular to saver sub using the torque wrench head while simultaneously suspending the weight of the top drive using the airbag;

j. releasing the torque wrench head from the first tubular using a set of multiple springs of the torque wrench assembly;

k. releasing the suspension of the first tubular from the slips; and l. rotating the first tubular to drill into the ground beneath the rig floor using the motor.

9. The method of claim 8, further comprising:

a. stopping the rotation of the first tubular;

b. suspending the first tubular with the drill bit from the slips;

c. closing the torque wrench head about the first tubular;

d. using the airbag to suspend the weight of the top drive to prevent damage to the threads during threadable disengagement of the first tubular from the saver sub;

e. threadably disengaging the first tubular from the saver sub using the torque wrench head while simultaneously suspending the weight of the top drive using the airbag;

f. releasing the torque wrench head from the first tubular;

g. grabbing a second tubular from the rig floor using the elevator;

h. lifting the second tubular from the rig floor until the second tubular is positioned to be axially aligned with the well bore center line;

i. lowering the second tubular through the rig floor substructure until threads of the second tubular engage the threads of the first tubular;

j. lowering the top drive until the threads of the saver sub engage threads of the second tubular;

k. using the airbag to suspend weight of the top drive to prevent damage to the threads during threadable engagement of the second tubular to the saver sub and to the first tubular;

l. threadably connecting the second tubular to saver sub and to the first tubular using the top drive while simultaneously suspending the weight of the top drive using the airbag;

m. releasing the suspension of the first tubular with the drill bit from slips;

n. rotating the connected tubulars to drill in the ground beneath the rig floor using the motor; and o. repeating steps a-n as more tubulars are required for drilling into the ground.

10. The method of claim 9, further comprising pulling out of the well bore by:

a. stopping rotation of the connected tubulars to cease drilling in the ground beneath the rig floor;

b. raising the connected tubulars until a connection of the tubulars is positionable to hang from the slips;

c. hanging the connected tubulars from the slips;

d. using the airbag to suspend the weight of the top drive to prevent damage to threads of the connected tubulars;

e. threadably disconnecting a portion of the connected tubulars, forming a stand of tubulars, while simultaneously suspending the weight of the top drive using the airbag, wherein the threadable disconnection includes:

(i) breaking out and unscrewing the stand of tubulars from the saver sub using the torque wrench head; and (ii) manually breaking out the stand of tubulars from the remaining connected tubulars suspended from the slips;

f. using the elevator to move the stand of tubulars to a racking position on the rig floor; and g. repeating steps (b)-(f) until all connected tubulars are out of the well bore.

11. The method of claim 10, further comprising tripping back into the well bore by:

a. using the elevator to lift a first stand of tubulars from the racking position;

b. using the elevator to lower the first stand of tubulars into the well bore and to hang the first stand of tubulars from the slips;

c. using the elevator to lift a second stand of tubulars from the racking position;

d. using the elevator to lower the second stand of tubulars into engagement with the first stand of tubulars;

e. using the airbag to suspend the weight of the top drive;

f. threadably connecting the second stand of tubulars to the first stand of tubulars and to the saver sub by:

(i) manually screwing the second stand of tubulars to the first stand of tubulars; and (ii) screwing the second stand of tubulars to the saver sub using the torque wrench head while simultaneously suspending the weight of the top drive using the airbag;

g. repeating steps (b)-(f) until all stands of tubulars are connected and disposed within the well bore; and h. actuating the motor to provide power to the top drive, thereby rotating the rotatable stem and the connected stands of tubulars with the saver sub to drill in the well bore.

12. The method of claim 9, wherein each tubular is grabbed from a V-door or mouse hole on the rig floor.

13. The method of claim 1, further comprising:

a. suspending a torque track from a crown of the derrick and connecting the torque track to the rig floor or to the rig floor substructure; and b. slidably attaching a torque slide assembly to the torque track.

14. The method of claim 13, further comprising:

a. engaging a top plate of the torque slide assembly with the top drive housing;

b. engaging a bottom plate of the torque slide assembly with the top drive housing; and c. engaging a rotatable slide door around a rectangular torque reaction tube of the torque slide assembly.

15. The method of claim 14, further comprising:

a. positioning the torque wrench assembly along at least one tubular for threadably connecting or disconnecting the tubular to the saver sub using a hydraulic cylinder disposed inside a pair of torque supporting telescoping rectangular tubes of the torque wrench assembly, wherein the hydraulic cylinder has a first end, a second end, and a single hollow cylinder rod;

b. connecting a first end of the single hollow cylinder rod to a top flexible conduit in fluid communication with a hydraulic fluid source for receiving hydraulic fluid;

c. movably positioning the first end of the single hollow cylinder rod to extend out of the first end of the hydraulic cylinder into a first protected area between the torque slide assembly and the top drive housing, wherein the top flexible conduit is disposed within the first protected area;

d. connecting a second end of the single hollow cylinder rod to a bottom flexible conduit in fluid communication with the torque wrench head for providing hydraulic fluid to the torque wrench head from the hydraulic fluid source;

e. movably positioning the second end of the single hollow cylinder rod connected to the bottom flexible conduit such that the second end of the single hollow cylinder rod extends out of the second end of the hydraulic cylinder and into a second protected area within the pair of torque supporting telescoping rectangular tubes, the torque wrench assembly, or combinations thereof, wherein providing hydraulic fluid to the torque wrench head through the top flexible conduit and the single hollow cylinder rod prevents flexing and axial movement of the bottom flexible conduit;

f. gripping at least one tubular using the torque wrench head before threadably connecting or disconnecting the tubular to another tubular or to the saver sub; and g. supporting weight of the at least one tubular with only telescoping movement using the pair of torque supporting telescoping rectangular tubes while threadably connecting or disconnecting the tubular to another tubular or to the saver sub, while simultaneously suspending the weight of the top drive using the airbag.

16. The method of claim 1, further comprising:

a. locking the connection of the inside blow out preventer to the rotatable stem using an upper clamp assembly; and b. locking the connection of the inside blow out preventer to the saver sub using a lower clamp assembly.

17. The method of claim 1, further comprising:

a. connecting the top drive housing to a wash pipe packing seal assembly; and b. flowing a pressurized mud from a reservoir, a pump, or combinations thereof, to the wash pipe packing seal assembly and to a central mud flow path of the top drive.

18. The method of claim 1, further comprising kicking out the elevator to grab the tubular from a pipe rack, a V-door, or a mouse hole using an elevator hydraulic cylinder.

19. The method of claim 1, further comprising powering the top drive using a hydraulic power unit.

20. The method of claim 1, further comprising using a hydraulic power unit that is built into a transportable shipping container to power the top drive.

* * * * *